US006515220B1

(12) United States Patent
Carpenter, Jr.

(10) Patent No.: US 6,515,220 B1
(45) Date of Patent: Feb. 4, 2003

(54) MOISTURE COLLECTING GROUNDING ELECTRODE

(75) Inventor: Roy B. Carpenter, Jr., Boulder, CO (US)

(73) Assignee: Lightning Eliminators & Consultants, Inc., Boulder, CO (US)

( * ) Notice: Subject to any disclaimer, the term of this patent is extended or adjusted under 35 U.S.C. 154(b) by 0 days.

(21) Appl. No.: 09/915,777

(22) Filed: Jul. 26, 2001

(51) Int. Cl.[7] ..... H01R 4/66

(52) U.S. Cl. ..... 174/7; 174/5 SG; 174/6; 174/2; 174/3

(58) Field of Search ..... 174/5 SG, 6, 7, 174/2, 3, 37, 135; 361/117

(56) References Cited

U.S. PATENT DOCUMENTS

| | | | | |
|---|---|---|---|---|
| 3,494,849 A | | 2/1970 | Hess | 204/197 |
| 3,582,531 A | | 6/1971 | Sheelor | 174/6 |
| 3,930,111 A | | 12/1975 | Sheelor | 174/5 SG |
| 4,861,940 A | * | 8/1989 | Carpenter, Jr. | 174/6 |
| 4,964,918 A | | 10/1990 | Brown et al. | 106/811 |

FOREIGN PATENT DOCUMENTS

| | | |
|---|---|---|
| FR | 1342964 | 10/1963 |
| GB | 2026783 | 2/1980 |
| RU | 0924780 | 4/1982 |

* cited by examiner

*Primary Examiner*—Anthony Dinkins
*Assistant Examiner*—W. David Walkenhorst
(74) *Attorney, Agent, or Firm*—Rick Martin; Patent Law Offices of Rick Martin, P.C.

(57) ABSTRACT

An improved grounding electrode system includes a moisture collector connected to a grounding electrode. The electrode may have a perforated conductive tubular assembly having at least two circular conductive collars. The whole electrode assembly is buried in the earth with the top end exposed and surrounded by an osmotic conductor. The tubular assembly can be filled with a chemical which enhances the soil conductivity. The moisture collector is preferably a mesh screen to condense moisture from the air and pipe it to the inside of the grounding electrode and/or to the surrounding soil. An osmotic conductor may be inside the electrode and/or in the surrounding soil.

20 Claims, 18 Drawing Sheets

$$\frac{dR}{d} = \rho \frac{d}{dr}\left[\frac{\ell}{A}\right]$$

WHERE:

$\ell$ = LENGTH

A = DIAMETER

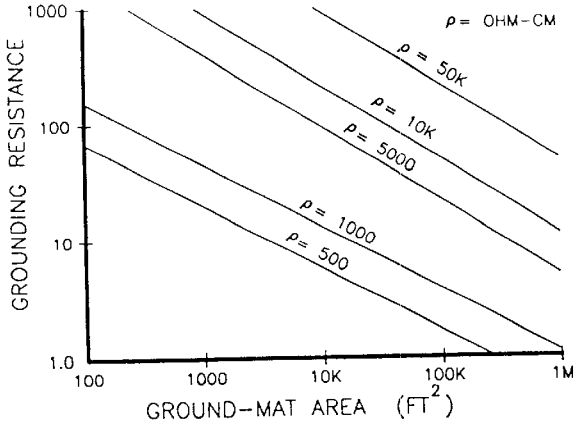

FIG. 16

FIG. 17

| MOISTURE CONTENT (% BY WEIGHT) | RESISTIVITY (Ω · CM) TOP SOIL | SANDY LOAM |
|---|---|---|
| 0 | >1000 $10^6$ | >1000 $10^6$ |
| 2.5 | 250,000 | 150,000 |
| 5 | 165,000 | 43,000 |
| 10 | 53,000 | 18,500 |
| 15 | 19,000 | 10,500 |
| 20 | 12,000 | 6,300 |
| 30 | 6,400 | 4,200 |

FIG. 18

| TEMPERATURE (°C) | (°F) | RESISTIVITY (Ω · CM) |
|---|---|---|
| 20 | 68 | 7,200 |
| 10 | 50 | 9,900 |
| 0 (WATER) | 32 | 13,800 |
| 0 (ICE) | 32 | 30,000 |
| −5 | 23 | 79,000 |
| −15 | 14 | 330,000 |

* SANDY LOAM, 15.2% MOISTURE CONTENT

FIG. 19

| SOIL | RESISTIVITY (Ω · CM) AVE. | MIN. | MAX. | RESISTANCE OF 5/8" (16 MM) X 10 FT (3M) ROD (Ω) AVE. | MIN. | MAX. |
|---|---|---|---|---|---|---|
| FILLS, ASHES, CINDERS, BRINE WASTE, SALT MARSH | 2,370 | 590 | 7,000 | 8 | 2 | 23 |
| CLAY, SHALE, GUMBO, LOAM | 4,060 | 340 | 16,300 | 13 | 1.1 | 54 |
| SAME WITH ADDED SAND AND GRAVEL | 15,800 | 1, 020 | 135,000 | 52 | 4 | 447 |
| GRAVEL, SAND, STONES, WITH LITTLE CLAY OR LOAM | 94,000 | 59,000 | 458,000 | 311 | 195 | 1516 |

MOISTURE COLLECTING GROUNDING ELECTRODE

FIELD OF INVENTION

The present invention relates to an improvement to an earth interface. A moisture collecting mesh screen collects moisture from the morning air which is laden with moisture. A conduit feeds this collected moisture to a grounding electrode. At least two collars may be fitted around the known chemically charged hollow grounding electrode installed in a hole. The moisture reduces the surge impedance of the grounding electrode with respect to earth.

BACKGROUND OF THE INVENTION

"Grounding" is the art of making an electrical connection to the earth. That ground connection is actually the interface with earth and through that interface, the grounded system is in electrical contact with the whole earth. Through that interface pass electrical "events" to and from the related system(s). These electrical "events" include power from the utility, communications, phone, radio, and other forms of data.

The character of this interface will determine the effectiveness of its function, i.e., how "good" is the interface and/or is there a reliable, year-round connection to earth. The effectiveness of an interface is usually assessed in terms of its true DC resistance to Mother Earth. However, there is another factor of greater concern to many, that is, the transient response or surge impedance, or the effective inductance of that interface. This factor will determine the effectiveness of that interface for such functions as lightning grounds, RF grounds, electric utility protection equipment grounds and personnel safety under "ground faulting" conditions.

The earth interface system is an important subsystem. The blind application of standards with little reference to the site character or the impact of seasonal changes will seldom yield an effective ground interface.

When the earth interface system has not been properly engineered, significant system equipment damage persists, personnel safety has been impaired and system performance has been less than ideal.

Finally, the trend toward microelectronics has made electrical and electronic systems even more sensitive to any form of anomalous electrical transients. Grounding, the earth interface, must now be considered a vital function and must be engineered for each site and/or system individually.

Grounding systems perform at least one of the following functions:

1. A Ground, or Earth Reference Electrode. Every electrical or electronic system must be referenced to the earth. This is referred to as "grounding". The grounding point in that system provides a common reference point for circuits within the system. In many cases, the resistance to earth of that reference point is of little significance. For these systems a Common Point Ground (CPG) will satisfy the functional requirements. These systems are usually totally self-contained or autonomously operated systems requiring no external interfaces except possibly the power, and present no potential for a compromise of personal safety. This form of grounding system, the CPG, mandates a separate connection from each element in the system to that CPG preferably via a separate path. A simple example of this CPG is a single computer terminal where the green wire in the power plug is the reference point.

2. The Lightning Neutralization Ground. Lightning protection grounding system requirements have conventionally been thought to be similar to the preceding, when in truth, they are quite different. A more descriptive title would be: "Lightning Charge Neutralization System". This comes about because of the nature of atmospheric electricity and the lightning strike mechanism. Storm clouds induce an image charge of equal but opposite potential in the earth beneath the cloud. When a lightning channel terminates on an earthen object, that channel forms a conductive path between the two bodies to permit equalization of the charge between them. Since the charge is induced on the surface of the earth, it follows that all of that charge must move from where it was induced to the strike channel terminus in order to neutralize the charge between earth and that cloud. All this must happen in 20 microseconds or so. If the facility of concern is part of the charged body or is the terminus of the strike, its grounding system must provide the low resistance, low surge impedance path from any point in the system to any other point in the system where the strike may terminate. Therefore, the grounding requirement for lightning protection is not just a low (DC) resistance to ground per se, but an interconnecting ground network that electrically interconnects every vulnerable component of the plant or system of concern with a low surge impedance path.

3. A Universal System. The universal grounding system may require a near perfect interface with the earth. That is, the lower the effective resistance between that system ground point and true earth, the better, safer, or more effective the system will be. This requirement is usually associated with systems that have many interfaces with other systems, or the "outside world". Typical examples include the electrical utility industry, the telephone central office and large industrial plants. These same systems often require a common point grounding (CPG), a lightning neutralization capability, and a low impedance interface with earth; thus providing a universal grounding (or earth) interface.

Soil augmentation is the process of replacing a portion of the local soil with a more conductive soil, or the replacement of poor (high resistance) soil in the critical areas. The new soil must be introduced around the grounding electrode since that is where it will be most beneficial. For years, a form of clay known as Bentonite has been used for this purpose. Its resistivity is found to be about 2.5 ohm-meters which is reasonably conductive. The usefulness of Bentonite is limited by two unfavorable characteristics:

a. Its volume sensitivity to moisture causes it to shrink away from the rod during long dry seasons, its volume can vary by 300%, thus, dramatically increasing the electrode resistance to earth.

b. Its low porosity limits its ability to conduct moisture and dissolved mineral salts into or through it.

To overcome these negative qualities, the present invention may optionally incorporate a product known as "Grounding Augmentation Fill" (GAF™). GAF™ has a resistivity of about 0.5 ohm-meters, it is highly conductive of both moisture and minerals and is far less susceptible to shrinkage.

The use of a good backfill such as GAF™ can significantly reduce the initial resistivity and the ultimate impedance to earth of a grounding electrode when properly utilized. The best use is for replacing the soil in the immediate area (six to twelve inches) surrounding the grounding electrode.

The present invention adds a moisture collector to a grounding electrode, thereby reducing the resistance between the grounding electrode and the surrounding soil.

SUMMARY OF THE INVENTION

Thus, the present invention improves an optimal universal grounding system by adding a moisture collecting system to a state of the art grounding electrode, and further adding an ideal backfill. Thus, even dry soils can be adapted to provide an adequate ground.

The foregoing grounding objectives are achieved by providing a conventional tubular member of an electrically conductive material. The tubular member is filled with a selected metallic salt matched to the soil condition. The tubular member is then buried and surrounded with an osmotically conductive material such as the Grounding Augmentation Fill (GAF™). The lower portion of the tubular member is a reservoir containing a saturated solution of that salt. The lower portion has provisions for the overflow of the salt from that reservoir so as to maintain a wet interface between the electrode and the GAF™ or a GAF™/soil mixture.

Two or more conductive rings or collars maybe added to the conventional structure of the hollow tubular member. The rings are nominally twelve to thirty-six inches in diameter, flat, and composed of copper or other highly conductive metal. Special situations could require much larger diameters. The surprising effect of the collars is to increase the effective diameter of the grounding electrode, thereby reducing the surge impedance of the grounding electrode by up to 40% with respect to earth as illustrated by FIG. 33. The collar diameter and position can also be varied to "tune to" the grounding electrode to a desired frequency. Use of two or more disks will integrate the backfill and/or soil into the rod and soil interface, thereby increasing the effective diameter of the rod. The surge impedance is thereby reduced. Finally, when a ground augmentation fill is used between the collars it makes better contact with the ground, thereby increasing the effective diameter of the rod to the diameter of the collars.

A preferred embodiment of the invention comprises a grounding electrode installed to provide an electrical interface with a soil for grounding various electrical and lightning protection systems, comprising: an electrode assembly comprising a conductive tubular member having an upper and a lower end and a plurality of holes formed in its lateral wall; at least one conductive collar affixed to the upper end of the conductive tubular member and positioned below the soil's surface; at least one additional conductive collar affixed to the tubular member below the first conductive collar; a removable filler plug mounted on the upper end of the conductive tubular member; an electrical connector mounted near the upper end of the conductive tubular member for the attachment of electrical connections; an end cap mounted on the lower end of the conductive tubular member; and an osmotic conductor filling a cylindrical hole in the soil and enveloping the portion of the conductive tubular member below the soil surface and contacting the plurality of holes.

The osmotic conductor can comprise some combination of a metallic salt, attapulgite and lignite. The conductive tubular member preferably contains at least one chemical capable of enhancing the soil's conductivity, the chemical being deposited into the interior of the tubular member so as to fully occupy its interior space. When the conductive tubular member is buried in the soil with the removable filler plug above the turf line, the conductive tubular member, the chemical contained therein and the osmotic conductor together provide a highly conductive interface with the soil. The grounding electrode can be electrically connected to at least one similar grounding electrode to provide a better grounding connection. The diameter(s) of the conductive collar(s) should be at least sufficient to reduce the surge impedance of the grounding electrode assembly.

A moisture collecting screen assembly is mounted near the grounding electrode(s). The moisture laden morning air condenses on the moisture collecting screen. The collected moisture seeps into the adjacent soil, thereby lowering the earth to electrode resistance.

Thus, this invention overcomes the known limitations of the prior art by providing an improved, passively rechargeable via the environment, chemically-activated, highly conductive grounding electrode in combination with a low-resistance soil within its immediate area.

The primary aspect of the present invention is to passively replenish the moisture in a grounding electrode and the surrounding soil with a moisture collector.

Another aspect of the present invention is to provide conductive collars on a hollow, tubular grounding electrode in order to increase the effective diameter of the grounding electrode.

Another aspect of the present invention is to bury the improved grounding electrode in an osmotic conductor, thereby further reducing the surge impedance of the combination.

Other aspects of this invention will appear from the following description and appended claims, reference being made to the accompanying drawings forming a part of this specification wherein like reference characters designate corresponding parts in the several views.

The new, useful and non-obvious improvement claimed herein is a combination of conductive collars affixed to a hollow grounding electrode, wherein this known apparatus is fed with a stream of moisture passively collected from the ambient air. The collars are usually flat, about twelve to thirty-six inches in diameter and preferably composed of copper. The hollow tubular grounding electrode is preferably filled with a metallic salt matched to the soil condition. The lower portion of the electrode has provisions for the overflow of salt from the internal reservoir so as to maintain a preferably wet interface between the electrode and the soil mixture. Finally, the entire assembly is buried in a hole which is filled with a backfill which is a low resistance soil. The collar helps to make the effective diameter of the electrode bigger.

Based on the foregoing, these further aspects are attained:

(a). a reservoir at the end of the electrode generates, maintains, and forces a saturated solution to wet a significant portion of the lower end of the electrode as ground water is admitted into the electrode, said reservoir being fed by a moisture collector.

(b). providing a rechargeable operating concept that permits periodic recharging and a constant feed of the required chemicals into the reservoir;

(c). providing an external osmotic conductor, GAF™, to assure the maintenance of a conductive interface at the most significant location, whereby the osmotic conduction is based on capillary action.

(d). providing ease of inspection and preventative maintenance;

(e). combining the useful features of prior art into this invention, thereby providing an electrode that will satisfy the requirements of even the most stringent applications.

BRIEF DESCRIPTION OF THE DRAWINGS

FIG. 16 is a graph of area limits on grounding resistance.

FIG. 17 is a table of moisture contents.

FIG. 18 is a table of temperatures.

FIG. 19 is a table of soils.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENTS

Figure 1:
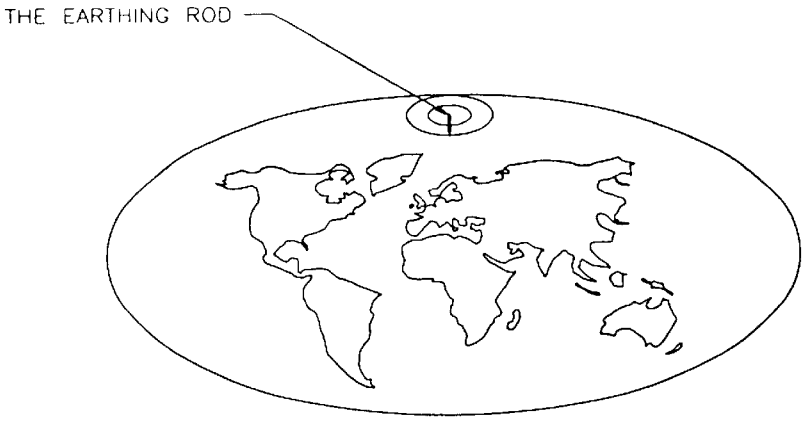
FIG. 1 is a picture of an earthing rod.
Figure 2:
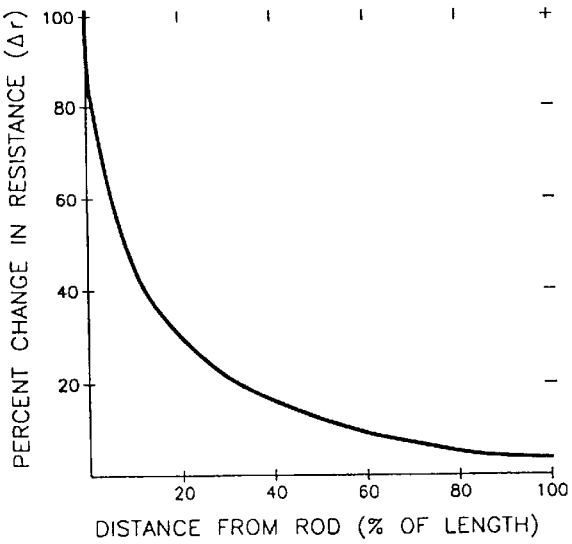
FIG. 2 is a graph of the length and resistance relationship of an electrode.
Figure 3:
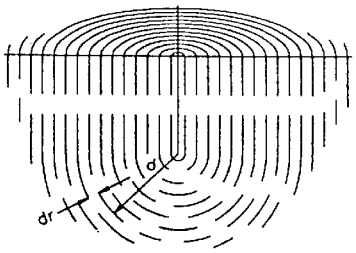
FIG. 3 is a diagram of shells of resistance of an electrode.
Figure 4:
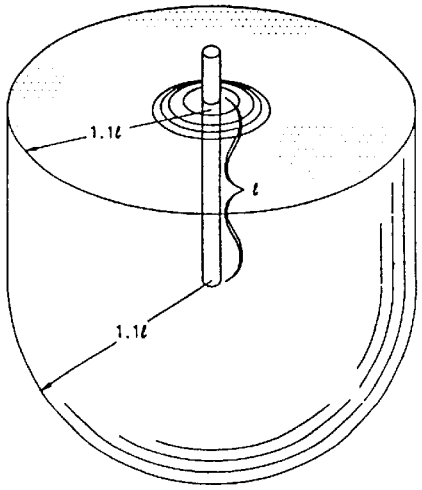
FIG. 4 is a diagram of an interfacing hemisphere.
Figure 29:
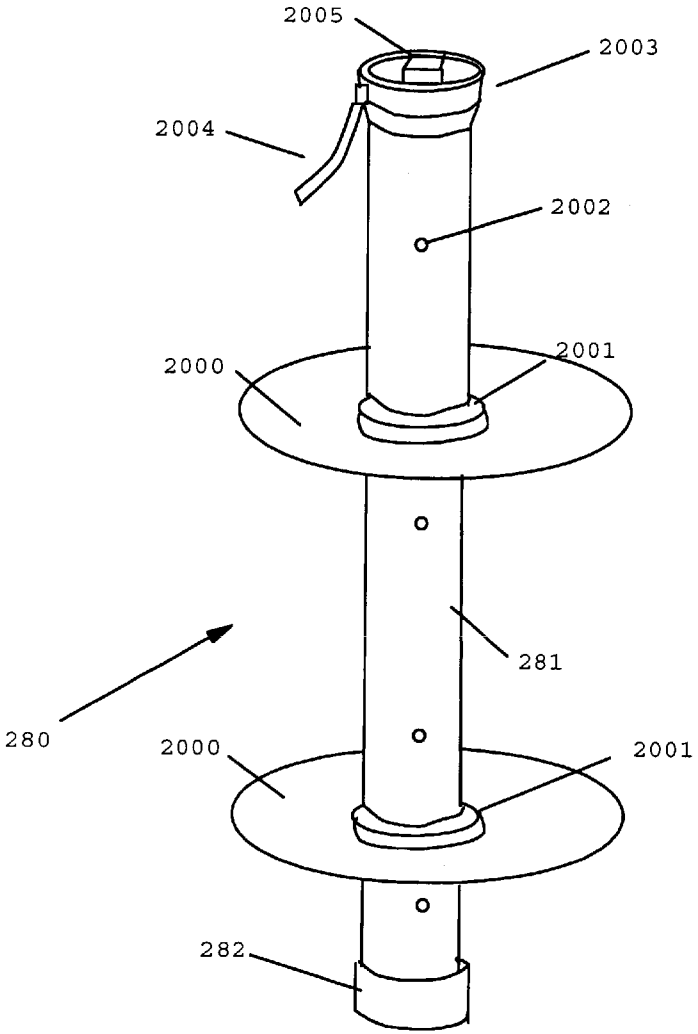
FIG. 29 is a top perspective view of the preferred embodiment shown in FIG. 28.
Figure 30:
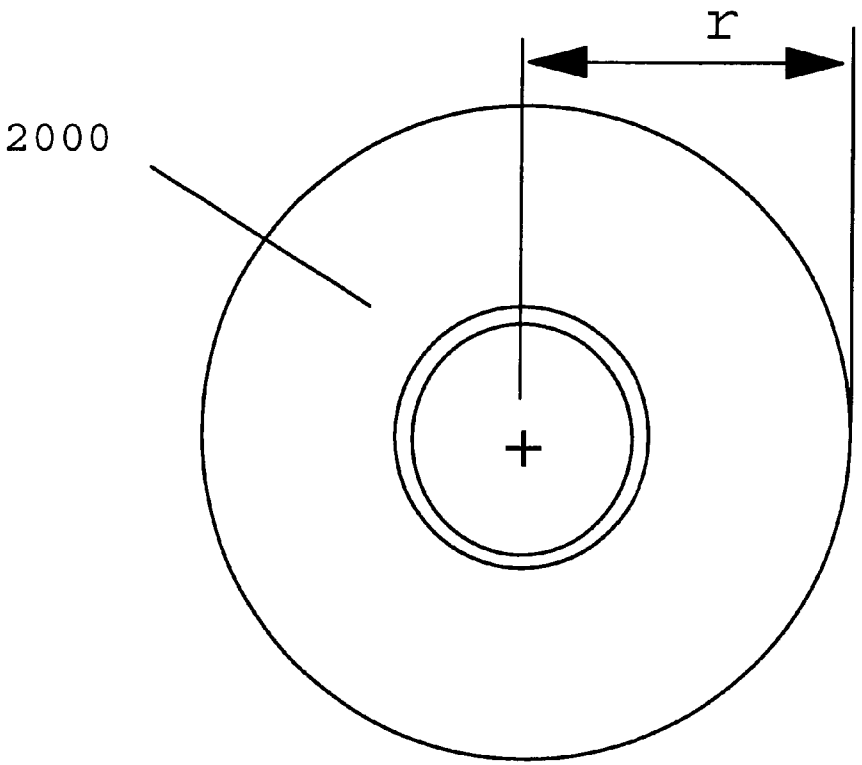
FIG. 30 is a top plan view of the conductive collar by itself.

Grounding is the process of making a connection between an electrical circuit and the whole earth. As illustrated by FIG. 1, this is not equivalent to "point contact" as in a soldered joint, but rather a connection between an electrode (the earthing rod) and the whole earth which is a semiconductor. To demonstrate this premise, a measurement may be made of the change in resistance along any radial starting from a ground rod and moving out along that radial in equal increments (X). The measured change in resistance (dR) will drop off exponentially with each equal increment of X (dX); in other words, dR/dX is a decaying exponential as illustrated by FIG. 2. From FIG. 3, it can be seen that the shells of soil surrounding the rod increase in diameter, and, therefore, impose less resistance than the prior shell. As these measurements are extended along the radial, the change in resistance becomes less and less perceptible. At some point, that change becomes unmeasurable. At that point, it has been estimated that between 90 and 95 percent of the earth connection has been completed. This is estimated to be a distance of about 1.1 times the length of the grounding electrode in the soil. The rest of the earth itself makes up the remaining percentage of that interface. The soil within a hemisphere formed by that radius has been referred to as: "The Interfacing Hemisphere" (IH) illustrated by FIG. 4. Obviously, the soil within the IH exercises the predominant influence on the grounding resistance of that electrode. It is key to the present invention to realize that a 10 to 20 percent increase of the effective diameter of the IH is obtained by the use of the collars (FIGS. 29, 30).

From FIG. 1, it can be deduced that the earth interface (grounding) is made up of two components:

$R_1$ The resistance of the soil within the Interfacing Hemisphere and:

$R_2$ The average resistance of the soil in the rest of Earth. However, it is also obvious that the soil in the immediate surrounding area will predominate because of the exponential relationship between grounding resistance and distance from the grounding rod (FIG. 2).

In summary, the resistance of an electrode to earth ($R_o$) is the sum of the two components: $R_1+R_2$.

Given the percent contribution of each component, $R_0$ is approximately:

$$R_0=0.9R_1+0.1R_2$$

Prior studies have found that the actual resistance of an electrode (rod) to earth ($R_0$) may be estimated from:

$$R_o = \frac{p}{1.92L}\ln\left[\frac{48L}{d}-1\right]$$

Where: p=Soil resistance in ohm-meters

L=Rod length in feet d=Effective rod diameter in inches for a conventional ¾ inch by 10 foot rod, this reduces to:

$R_0$=0.216 p, or more exactly:

$R_0=0.216\ [0.9\ p_1+0.1\ p_2]$

Where: pl=The soil resistivity within the Interfacing Hemisphere.

$p^2$=The average soil resistance in the general area; i.e., the first 100 yards or so.

For the effective rod diameter of 24 inches, $$R_0=0.153\ [0.9\ p_1+0.1\ p_2].$$

The reduction of the grounding impedance is 41%.

The earth connection (grounding) is influenced by both the character of the electrode and the soil conditions as seen from the preceding. The specific variables include:

1. For the Grounding Electrode

Length, width (diameter) and method of deployment (i.e., horizontal, vertical, slant) and shape.

2. For the soil

Its resistivity varies with soil type, moisture, temperature, mineral content, and compactness.

The following is an assessment of the factors of significance in determining the resulting resistance to earth.

Electrode Factor Influences

The grounding electrode can be a rod, a wire, a pipe, a plate, any shaped piece of metal or even a semiconductor such as a carbon block. FIGS. 5–8 illustrate the influences of some of these electrode factors when the referenced soil is assumed to be 100 ohm-meters resistivity, unless otherwise noted. The performance in other soil resistances will vary accordingly. The single driven conductor is the most common form of grounding electrode. Its utility value depends on its ability to make an acceptable low resistance contact with true earth. Without attempting to change the conductor's environment (the soil), there are two variables to consider: its length, and its diameter. Shape variance can be reduced to one or a combination of these. Plates, ribbons, and other non-standard shapes have proven to be a less effective use of the grounding elements.

Figure 5:
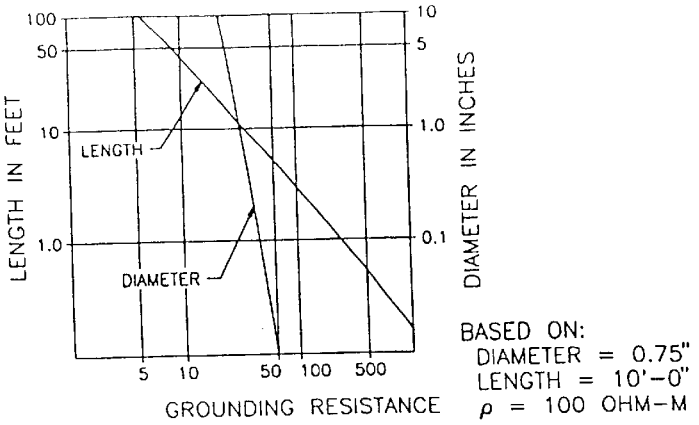
FIG. 5 is a graph of grounding resistance.
Figure 6:
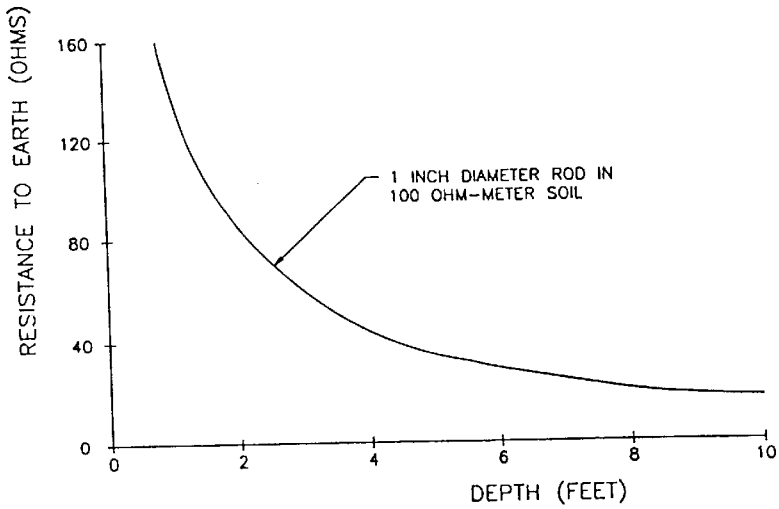
FIG. 6 is a graph of rod length versus resistance.

FIG. 5 illustrates the grounding resistance to be expected from various rod diameters and lengths when driven into 100 ohm-meter soil. Note that the scales are log-log; therefore, the return in reduced resistivity per linear charge in a dimension becomes less and less as it increases. FIG. 6 illustrates this graphically. As the length of the rod increases, the change in resistance decreases. It would appear that rods in excess of 10 ft. long are a waste, if, and only if, there is enough moisture present throughout the year and the temperature of the soil remains above freezing. Consider one example in which a ¾ by 10 ft. rod yielded 100 ohms. That same rod extended to 100 ft. reduced the resistance to only 50 ohms in the same soil.

Figure 7:
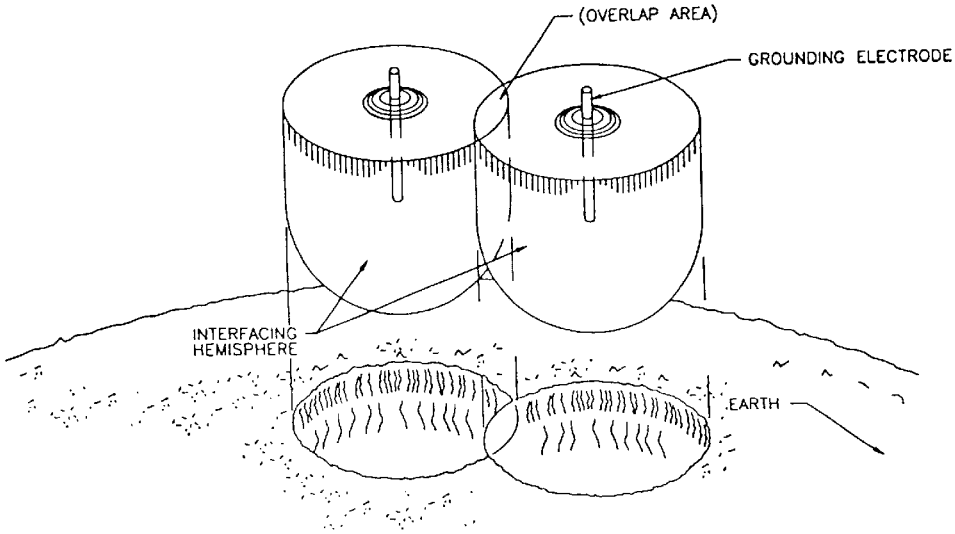
FIG. 7 is a diagram of rods too close.

Rods too close together, as illustrated by FIG. 7, result in two or more rods using the same interfacing soil, causing a proportional loss in interface effectiveness as a grounding electrode. The longer the grounding electrode, the larger the diameter of its Interfacing Hemisphere. As an example, each 10 ft. rod requires 22 ft. of interfacing soil; a 100 ft. rod requires 220 ft. for an effective interface.

Figure 8:
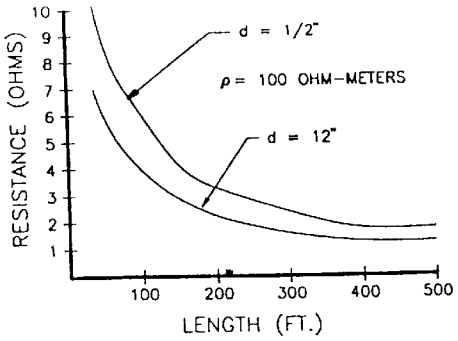
FIG. 8 is a graph of horizontal conductor's length versus resistance.

For horizontally deployed conductors, FIG. 8 presents some estimate of the grounding resistance achievable for various lengths and diameters. A depth of between 4 to 6 feet yields the best results. The measured ground resistance is most sensitive to length. Larger diameters help lower the DC resistance, but are most desirable for high frequency applications. Diameters of 0.5 to 1.0 inch are satisfactory for DC and low frequency applications; however, the larger the diameter, the better it is for lightning protection and fault current protection due to the surge impedance factor and greater soil contact.

These soil factor influences provide the predominating influences on the ultimate grounding resistance. Such related factors as type, temperature, moisture content, mineral content, compactness, and granularity all influence the ultimate resistance of the soil. However, of these factors, moisture, mineral content, and temperature exercise the greatest influence as can be seen from the subsequent data presented by FIGS. 9–15. All three factors vary with the time of year and the local climate, which can cause soil resistance to vary by up to 250 percent.

Moisture Content

Figure 9:
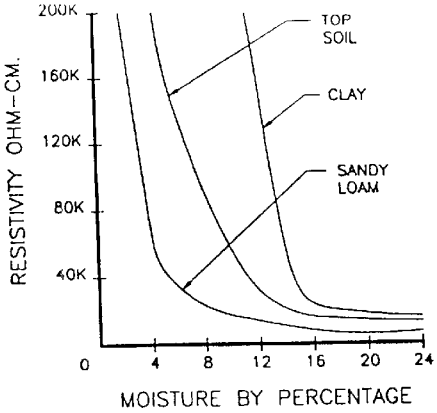
FIG. 9 is a graph of moisture versus resistance.

Variations in the amount of ground water distributed within the soil will exercise a profound influence on the actual instantaneous soil resistance. As illustrated by FIG. 9, it can cause the resistance to vary from the soil's lower limit to near infinity (too high to measure). As examples, sandy loam is reasonably conductive with only 4-percent moisture, while clay requires over 14-percent by weight of the variable.

This data also infers a significant variation in measured resistivity between the wet and dry seasons. This variation can range over several hundreds of percent. FIGS. 17 and 18 present some specific examples.

Unfortunately, a manual mix of salt and soil deteriorates rapidly with time. After a year or so, its resistivity returns to nearly the original value. Remixing is usually impractical or much less effective than the first mixing. Subsequent uniform mixing is difficult to accomplish.

To properly design a grounding system or even select the type of electrode(s) to use, it is essential to properly define the environment within which the system must function. The factors to assess have been defined in the preceding section. It must be the objective of this activity to collect all the data required to define the soil resistivity under all the conditions it encounters throughout the years in the specific location of concern. The following data are required:

1. Soil resistance at a given time of year.
2. Resistance variation as a function of soil depth, to at least 30 feet.
3. Moisture content at time of measurement (% by weight).
4. Moisture variation over the average year.
5. Temperature at time of measurement.
6. Temperature variation over the average year.
7. The average frost depth in winter, where applicable.

In the process of collecting these data, it should be understood that inaccuracies in any of the foregoing data will lead to inaccuracies in the designed system. Where it is not possible to define all parameters specifically, it is then necessary to determine the potential variation in a given parameter(s), and include an estimate as such in the design problem.

In making the soil resistance tests, care must be exercised to assure a close approximation of the true value for a given assumed situation. That is, tests should be made at different angles and locations on the site. The number of measurements should be not less than five and as many as ten to assure an accurate assessment and eliminate the potential influences of buried conductors and variations in moisture conditions.

Given the soil resistance measurements and the conditions under which they were taken, an estimate of the potential soil resistance can be derived for an average year. FIG. 19 illustrates the potential range in a resistance that can be expected for several soil types over a period of several years. From these data, it is important to note that resistances varying over several orders of magnitude are not unusual. These conditions are to be expected and need to be provided for in the design, or the resistance parameter must be controlled.

Soil Temperature

Figure 10:
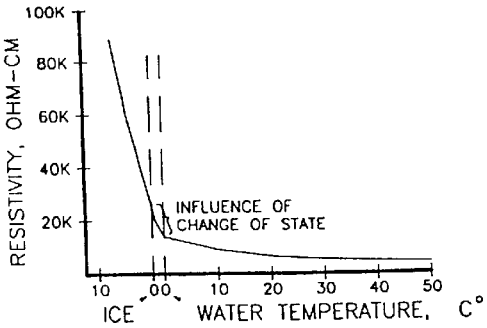
FIG. 10 is a graph of temperature versus resistance.

Soil resistivity is nearly independent of its temperature until its moisture content reaches freezing point. Then, as indicated by FIG. 10, the resistivity of the soil increases very rapidly to a point where there is virtually no contact with earth at all. Obviously, any steps that can be taken to lower the freezing point of the earth's moisture will also improve (i.e. reduce) its resistivity, particularly in cold climates. Permafrost is a specific situation that requires special attention. Soil resistance under these conditions can easily exceed 1 million ohm-cm.

Granularity/Compactness/Density

All of these factors influence the soil conductivity. In general, the denser the soil (the smaller the particle size), the lower the resistivity. However, this only holds true if the soil is porous to water or conductive to osmosis or capillary action. These factors do not vary significantly over the year. Once the resistivity has been assessed, these factors can be ignored.

Mineral Content

Figure 11:
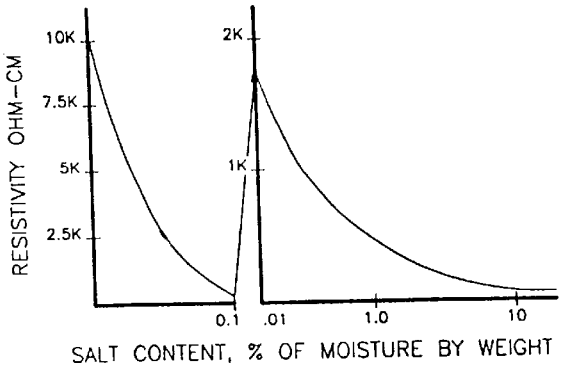
FIG. 11 is a graph of salt content versus resistance.

A concentration of certain minerals, acids and hydroxides can improve soil conductivity markedly. The higher the concentration, the lower the average resistivity. However, too much concentration can have a negative impact on the grounding electrode itself. FIG. 11 presents an estimate of a given soil resistivity as a function of its soil metallic salt (NaCl) content. In this situation, the soil was mixed with charcoal and a water solution of the salt. Although table salt is commonly used, many other metallic salt solutions will work as well. Note that the resistance decreases exponentially with salt content until about a 10% solution (by weight) is achieved. Beyond this, there is little influence.

The choice of salts can influence the depletion rate significantly. For example, NaCl goes into solution about 24 times as fast as Tri-Sodium Phosphate. However, both enhance conductivity equally well.

Conventional Grounding (Earthing) Designs

Single Rods

Conventional designs are based on the use of conventional grounding electrodes (rods). These include solid rods of copper clad steel, stainless steel, or galvanized steel. The first step is to estimate the resistance (R) of one rod to earth. This may be found from the following:

$$R_o = \frac{p}{1.92L}\ln\left[\frac{48L}{d} - 1\right]$$

Where: p is the soil resistance in ohm-meters

L is the rod length in feet d is the rod diameter in inches.

This reduces to:

R=0.337 p ohms for a ¾ inch by 10 ft. rod, or:

R=0.55 p ohms for a ½ inch by 6 ft. rod.

From an earlier figure we found that the diameter of the rod has very little influence on the grounding resistance. For example, a ¾ inch by 6 ft. rod is:

R=0.52 p ohms vs. 0.55 p for the ½ inch rod.

For the effective rod diameter of 24 inches, $$R_0=0.153\,[0.9\,p_1+0.1\,p_2].$$

Since the use of a 12-inch diameter collar, with the very low resistance backfill (GAF™) increased the effective diameter to about 12 inches, the Effective Impedance is reduced to (R):

R=0.139 p ohms

A 24-inch collar in a hole backfilled with GAF™ reduces the impedance to (R):

R=0.103 p

Note: Always round off the numbers to the second place. Better accuracy is not possible and misleading.

Figure 12:
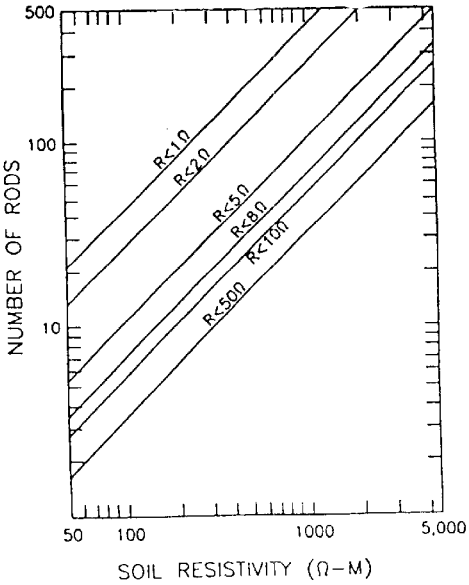
FIG. 12 is a graph of rod count versus resistance.
Figure 13:
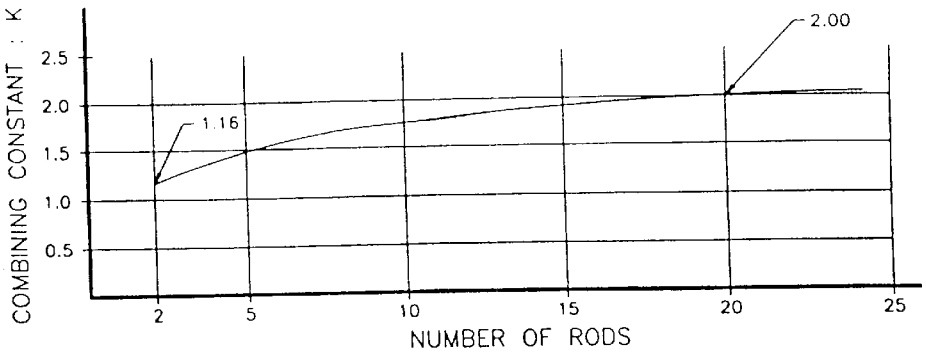
FIG. 13 is a graph combining constants for multiple rods.

Multiple Rods when one rod will not achieve the desired objective, multiple rods may be considered. However, care must be exercised to assure that there are no significant overlaps between their Interfacing Hemispheres (IH). Given a fixed area to work within, there is a practical limit to the number of rods that can be properly deployed within the area, as illustrated in FIG. 12. The shorter the rod, the greater the number of rods that will fit. Under ideal conditions, many short rods are often better than a few long ones.

Once the resistance of one rod ($R_1$) has been estimated, the resistance for multiple rods ($R_N$) can be estimated from the following relationship:

$$R_N = \frac{R_1 K}{N}$$

Where: N=the number of rods.

Figure 14:
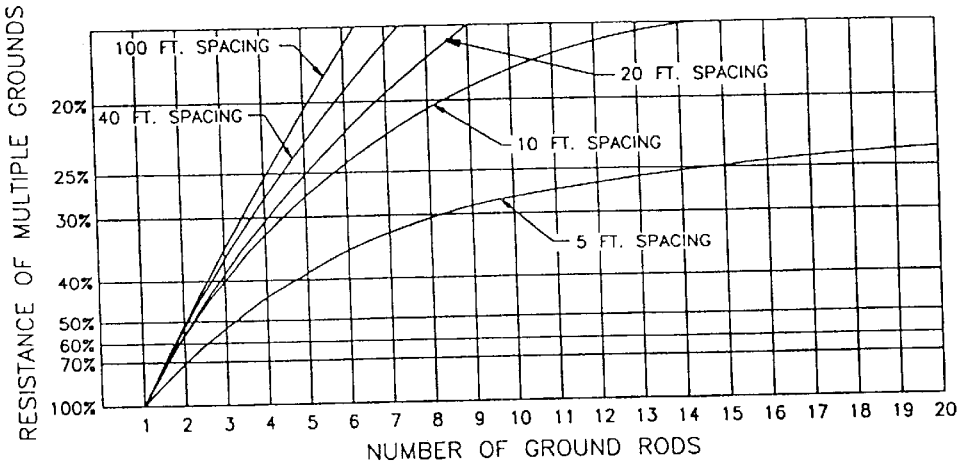
FIG. 14 is a graph of spacing impact on combining constants.

K=is combining constant taken from FIG. 29 which is based on the 90 to 95 percentile spacing criteria; FIG. 14 illustrates the impact on K for closer spacing.

By varying the assumed length/diameter of the rod, and the number of resulting Interfacing Hemispheres, the optimum combination for a given area may be determined. The result will be the lowest resistance obtained ($R_N$) under conventional conditions.

For example, consider the situation where there is only 2000 square feet of land available and the soil resistivity is 100 ohm-meters.

a). with ¾ inch by 10 foot rods, the resistance of one rod is:

$$R_1=(0.377)\ (100)=33.7 \text{ ohms}$$

Only 5 rods can be used because its IH is 22 feet in diameter; therefore $R_N=R_5=9.98$, or about 10 ohms b). with ¾ inch by 5 foot rods, one rod is:

$$R_1=(0.52)\ (100)=52 \text{ ohms each;}$$

its IH is only 11 feet in diameter.

Since ten of these shorter rods will fit within the given space, $R_{10}=8.8$ ohms.

In this situation, the larger number of shorter rods produces a somewhat lower resistance. Again, this is based on the presence of enough moisture in the first five feet of soil throughout the year; and the fact that the soil is uniform within the rod's IH. Stratification of the soil can change this to some degree, often in favor of the short rods.

The Effects of Soil Stratification are Significant

All of the previous data was based on the premise that the soil around the grounding electrode(s) was reasonably uniform. However, in the real world that is often not true. The norm is at least two strata within ten feet of the surface, and sometimes more. Further, it is usually true that the upper strata are the more conductive when and if there is sufficient moisture throughout the year.

Figure 15:
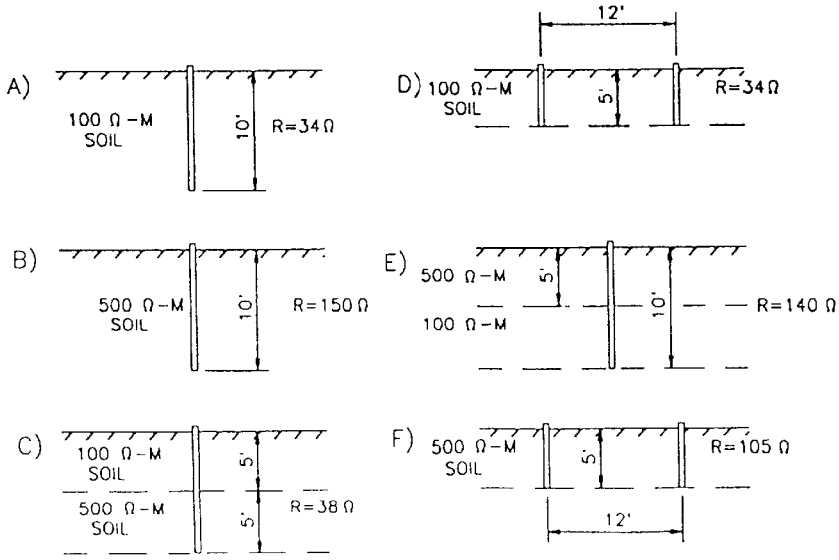
FIG. 15 (*a–f*) are diagrams of the influences of stratified soil.

The influence of stratification can best be illustrated by the situations depicted in FIG. 15. Six situations have been illustrated, using two soil conditions: 100 ohm-meter and 500 ohm-meter soils. The following facts were identified:

1. A ¾ inch by 10 foot rod provided 23 ohms grounding resistance in all 100 ohm-meter soil;
2. That same rod in all 500 ohm-meter soil provided 150 ohms grounding resistance;
3. That same 10 foot rod in 5 feet of 100 ohm-meter top soil and 5 feet of 500 ohm-meter subsoil provided a 38 ohm ground.
4. However, that same 10 foot rod cut in half, and each piece driven to a depth of 5 feet, separated by 12 feet, provided ¾ ohms resistance;
5. Reversing the strata sequence to the first 5 feet of soil being 500 ohm-meter and the second 5 feet of soil being 100 ohm-meter the 10 foot rod offered 140 ohms of resistance; only 10 ohms less than if the soil were all 500 ohm-meter.
6. While the two five-foot rods in the 500 ohm-meter soil provided a resistance of only 105 ohms, this is significantly better than the single ten foot rod.

The conclusion should be obvious. More often than not, the use of many short rods, which permits closer spacing, provides a lower resistance than a lesser number of longer rods. This is true even when the lower strata are more conductive. As with any generalities, there are exceptions. In very arid areas and dry soils, low resistance grounds are impractical with conventional technology. These areas must be treated with moisturization, or longer rods used to reach the moisture. In these cases, the length of rod in dry soil is not included in the IH estimate.

Where soil resistivity is high and the available space is limited, there is a limit beyond which the resistivity can not be reduced by conventional technology. If one ohm resistance is required in 1000 ohm-meter soil, a million square feet of land is required to achieve that goal.

The use of a good backfill like ground augmentation fill (GAF™) can significantly reduce the initial and ultimate resistivity of a grounding electrode. GAF™ is typically comprised of the following components measured in weight percent:

| | |
|---|---|
| A metallic salt | 10% |
| Attapulgite | 50% |
| Lignite | 40% |

An alternate version contains about 10 percent metallic salt, 35 percent attapulgite, 20 percent lignite and 35 percent Bentonite, all measured in weight percent.

The ingredients of GAF™ can be combined in the following approximate proportional ranges:

| | |
|---|---|
| Metallic salts | 5–15% |
| Attapulgite | 40–60% |
| Lignite | 30–50% |

With all percentages by weight.

Attapulgus Clay (Attapulgite, Palygorskite)

Characteristics:

Attapulgus clay is usually called attapulgite, which comprises 80 to 90% of the commercial product. Montmorillonite, sepiolite and other clays, and quartz, calcite, or dolomite make up the remainder of the commercial product. As a drilling mud material, attapulgus clay is called salt gel, brine gel, etc., because it is used as a suspending agent in salt solutions. Attapulgite is the principal member of a group of sorptive clays, called "fuller's earth" because such clays were first used to remove grease from woolen cloth. These clays are widely applied as clarifying and decolorizing agents, filter aids, catalysts, general absorbents, and pesticide carriers. The name attapulgite comes from Attapulgus, Ga., the source of the first samples studied by DeLapparent in 1935. A similar clay found in the Palygorsk Range of the Ural Mountains in 1861 had been named palygorskite. These clay minerals are structurally the same.

Attapulgite has a fibrous texture. Chemically, it is a crystalline hydrated magnesium silicate, with partial replacement of magnesium by aluminum, iron, and other elements. Particles are needle-like in shape, and the crystal structure is that of a double chain of silicon and oxygen linked by magnesium and calcium.

The electron microscope shows the characteristic brush-heap appearance of the loosely packed needles.

When placed in water, attapulgite does not swell like bentonite, but must be dispersed by vigorous stirring to break up the bundles of lath-like crystals. Stable suspensions result from the random structure that entraps water from the large surface area available for absorption of the polar water molecules.

Attapulgite is also called salt gel and is used as a viscosifier in drilling fluids where the salinity exceeds 1 35,000 mg/l and bentonite becomes ineffective. It is a fine cream-colored powder. The approximate formula is:

$$4H_2O.\ H_4Mg_5(OH)_6Si_8O_{20}.$$

Physical and Chemical Properties:

| | |
|---|---|
| Specific gravity: | 2.4 |
| Bulk Density: | 720–770 kg/m$^3$ (45–55) lb./ft$^3$) |
| Solubility: | insoluble in water but disperses fairly readily to give a light brown slurry. |

Salt Gel is made up of thin rod-shaped particles that behave differently from Bentonite platelets. Salt Gel is a very effective viscosifier in salt-water fluids and saturated brines. It gives better shear thinning characteristics than bentonite. Salt gel systems are much less affected by prolonged periods at high temperature than are bentonite slurries and will exhibit stable rheology under high temperature conditions.

In summary, the advantages of attapulgite for a ground electrode backfill include no shrinkage when dry and osmotic properties in salty earth.

Figure 20:
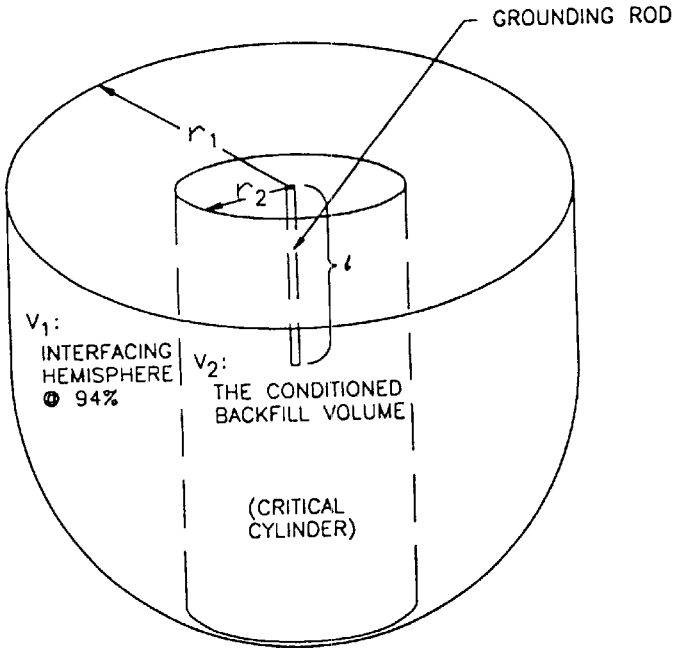
FIG. 20 is a diagram of a critical soil cylinder.
Figure 21:
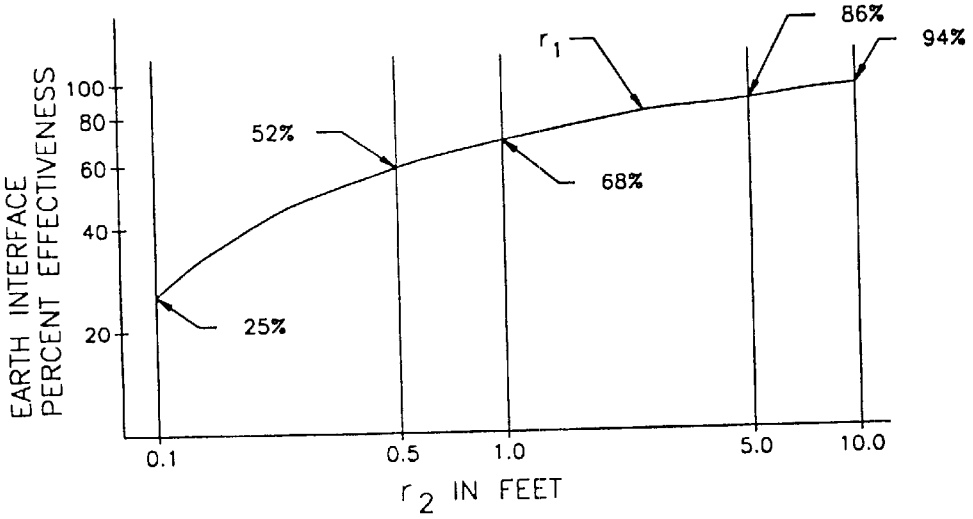
FIG. 21 is a graph of soil influence within the critical cylinder.

Please refer to FIGS. 20, 21. FIG. 20 illustrates the IH for a typical rod with an inner cylinder (critical cylinder). Assuming that the critical cylinder is of the same volume as the IH that has been replaced with GAF™, the impact on the grounding resistance can be determined from the data in FIG. 21 and from the following:

The resistance of a rod with the IH ($R_0$) is now the product of two resistances, $R_1$ and $R_2$ in series or: $R_0=R_1+R_2$. However, the resistance of the two components $R_1$ and $R_2$ is a function of the radii $r_1$ and $r_2$, or the size of the critical cylinder filled with the GAF™.

If a 12 inch hole is augered and GAF™ is used:

$$R_0=0.275\ [(0.52)\ (0.8)+(0.48)\ p]$$

Where: p is the resistance of the remaining soil in the IH.

If a 24-inch hole is augered and backfilled with GAF™,:

$$R_0=0.275\ [(0.68)\ (0.8)+0.23p]$$

Figure 22:
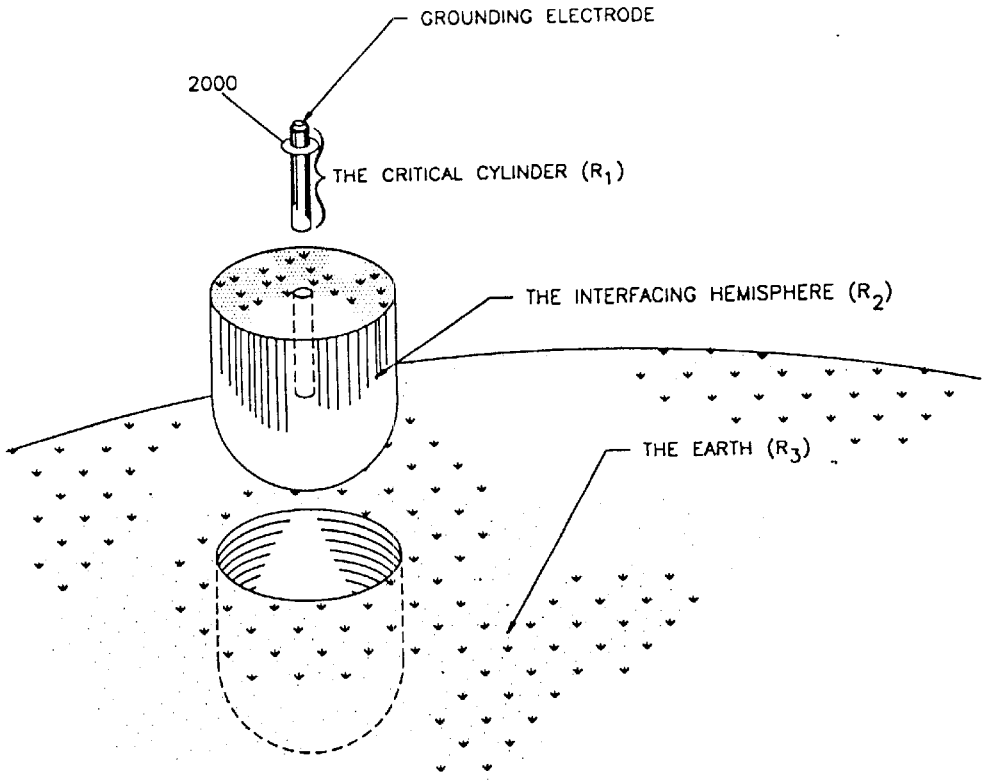
FIG. 22 is a diagram of the critical cylinder in the earth.

It can be shown that in most cases where multiple rods are required, the use of a 24-inch hole backfilled with GAF™ is the most economical approach. Finally, to be completely accurate, the equation for the rod resistance $R_0$ should take into account the impact of the remaining 5 to 10 %; that is, the rest of the earth. However, to be practical, this can be reduced to the average soil resistance within the immediate area (p). Therefore, the actual resistance of a rod backfilled with GAF™ is the product of three components: $R_1$, $R_2$, and $R_3$ as illustrated by FIG. 22. However, $R_3$ can normally be neglected. It only becomes significant when both $R_1$ and $R_2$ are very low. For example, if the grounding system is installed in a salt marsh surrounded by dry sandy soil in excess of 100 ohm-meters resistivity, when the grounding resistance would be predominated by the value contributed by only $R_3$. For example, if the surrounding remote soil is 500 ohm-meters, the $R_3$ components would be 17 ohms for a ¾ inch×10 foot rod.

Dealing with Permafrost

Grounding in Permafrost or in areas with deep frost lines requires a special form of grounding. As previously indicated by FIG. 10, when the temperature is well below freezing, the resistivity of the local soil increases by factors of 10 to 1000 or more. Under these conditions, conventional grounding techniques are impractical. Use of explosives in the form of "Shaped Charges" or augered holes seems to be the only reasonable solution to facilitate the implanting of a grounding electrode in permafrost. The larger the diameter and the deeper the hole, the better the grounding interface. In every case, a conductive, low freezing point backfill is required. GAF™ is ideal for the application.

In some areas the permafrost soils were found to extend to 800 feet in depth. However, fresh water lake bottoms never froze. Resistivities of the permafrost varied from a "low" of 1000 ohm-meters to highs on the order of 18,800 ohm-meters. In contrast, lake bottoms averaged 38 ohm-meters.

To achieve a grounding interface in these areas, either the rods must be driven into the lake bottom where available, or holes must be augered into the permafrost to depths of at least six feet for the grounding electrode. Resistance as low as 175 ohms is obtainable with one rod using a conductive, low freezing point backfill such as GAF™.

Figure 23:
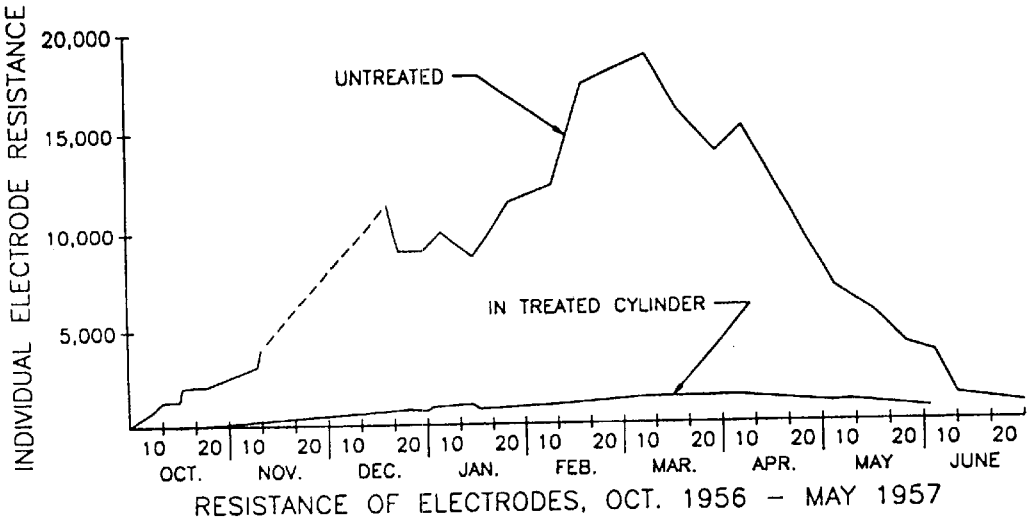
FIG. 23 is a graph of resistance in permafrost.

FIG. 23 contrasts the difference between rods in untreated soil and those in a cylinder of conductive backfill such as GAF™, through the winter months at Point Barrow, Alaska. Note that the resistances peaked at over 20,000 ohms in untreated soil and about 1200 ohms in the conductive backfill. The greater the amount of GAF™ used, the lower the resulting resistance at any point in time.

The expected resistance using this approach can be estimated by utilizing the prior reasoning based on FIGS. 20, 21. However, the ultimate resistance is almost totally dependent on the backfill. The initial resistance of one electrode ($R_1$) is therefore:

$$R_1=0.275\ (C_1\ p_1+C_2\ p_2)$$

Where $C_1$=hole size effectiveness factor (FIG. 37)

$p_1$=the resistivity of the backfill $C_2$=1 minus $C_1$

P2=the resistance of the local permafrost soil

However, please note that use of the collars (FIGS. 29, 30) will increase the effective diameter of the Interfacing Hemisphere by between 10 and 20 percent. The use of multiple rods is required to achieve low resistances. The techniques previously defined apply in the design of a grounding system for permafrost sites and those where deep frost is encountered yearly.

Figure 24:
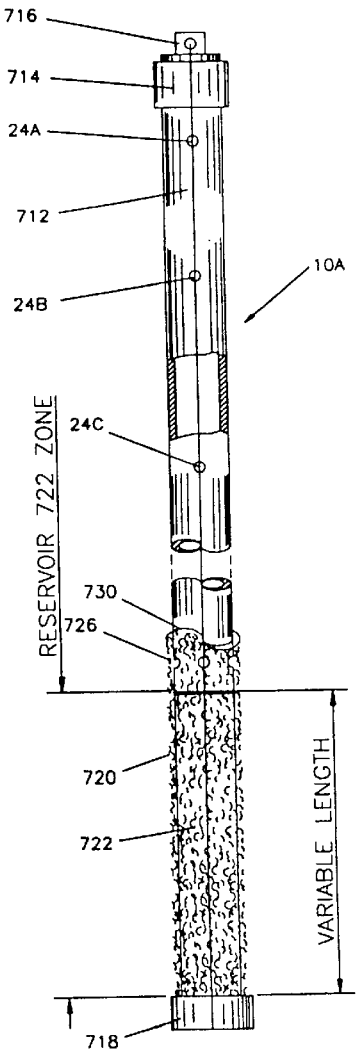
FIG. 24 (PRIOR ART)
FIG. 24 (prior art) is a front elevational view of a typical, vertically- positioned, buried electrode and the access port for recharging the chemical content.
Figure 25:
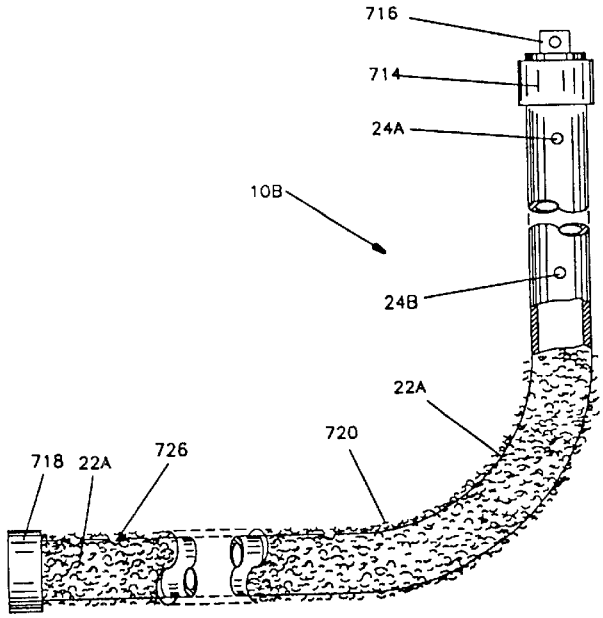
FIG. 25 (PRIOR ART)
FIG. 25 (prior art) is a front elevational view of an electrode having a substantially horizontal extension which is buried.
Figure 26:
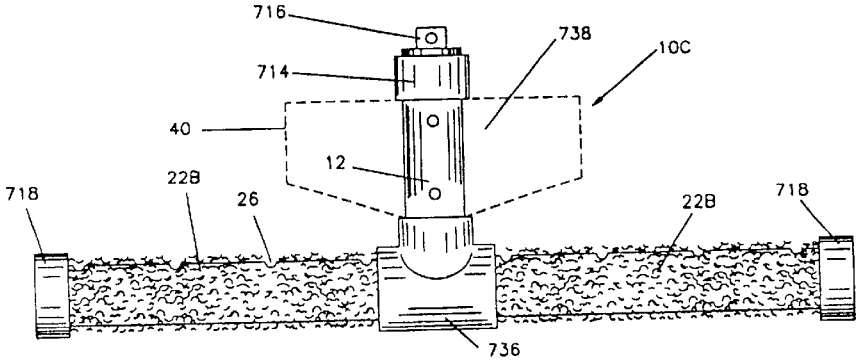
FIG. 26 (PRIOR ART)
FIG. 26 (prior art) is a front elevational view of an electrode assembly accommodating two horizontal reservoir sections connected to a tee union and extending in opposite directions from a vertical chemical supply tube and buried horizontally.

The preferred electrode embodiments can be seen in FIGS. 24–26. FIG. 24 portrays a typical grounding electrode assembly 10A, which consists of a metallic tubular member 712 having an upper coupling adapter 714 positioned at approximately turf-line level. A removable plug 716 and end cap 718 are attached to the upper end and lower end of metallic tubular member 712. A plurality of holes 24A, 24B and 24C are formed in the lateral wall of the metallic tubular member 712. These holes serve as ports. They start about six inches below the removable plug 716 and are spaced at intervals varying from 12 to 24 inches from each other vertically along a line between the first hole 24A at the top and the zone designated "reservoir 722". A collar 2000 as shown in FIGS. 20, 22 can be added to any of the embodiments of FIGS. 24–26 to enhance performance.

The base of the assembly constituting said reservoir 722 may vary in length and in height, respectively from a minimum of two feet to in excess of five feet. The top 730 of said reservoir 722 is terminated above the location of four holes 726. Holes 726 are positioned 90 degrees to each other in the wall of said metallic tubular member 712. Holes 726 are enveloped by an osmotic conductor 720 positioned along the respective outside of said reservoir zone 722.

Preferred metals for the material of the metallic tubular member 712 are copper, stainless steel, bronze, zinc-coated steel and comparable electrically conductive materials.

The metallic tubular member 712 is equipped with operational component parts as mentioned in the foregoing summary. The previously discussed GAF™ osmotic conductor 720 is symbolically shown in FIG. 24.

The grounding electrode variety 10B is illustrated in FIG. 25 in an operational mode. This electrode 10B draws moisture into the metallic tubular member 712 through the ports furnished by the holes 24A and 24B. The metallic salts (not shown inside 10B) absorb that moisture slowly, forming a saturated solution in the reservoir 22A. (See details in FIG. 24). This process is initiated by filling the reservoir 22A with the applicable chemical through the filler plug 716. The grounding electrode assembly 10B as shown in FIG. 25 presents the geometry for cases where a horizontally acting soil treatment is desired or required. The applicable component parts and their operation are identical to those of the electrode assembly type 10A in FIG. 24.

FIG. 26 shows at 10C a specialized design for soil treatment in a predominantly horizontal orientation. The metallic tube 812 is equipped at its top with an upper coupling adapter 714. The upper coupling adapter 714 is located at turf-line level. The filler plug 716 has a port hole 28. The filler plug 716 is mounted with its lower end in the center port of the tee union 736. A reservoir 22B is installed at each of the two side ports of the tee union 736.

It should be noted that the expressions "upper" and "lower" are applied to the relations of substantially vertically positioned assembly parts. The references "near" and "far" are employed for the description of the geometry of horizontally extending assembly members.

In FIG. 26 an additional storage space for the incident chemicals may be desirable. This is due to the comparatively short height of tubular member 812. A suitable location and shape for a container 738 may be as indicated by a dashed outline 740 of its possible profile projection.

The chemical mixes in all the above-described configurations vary with the soil type and moisture content. As examples, for general use a combination of 10% tri-sodium phosphate crystals, 10% sodium chloride crystals, and 80% sodium chloride cubes is used. The crystals are approximately ¼ inch in diameter. The cubes are approximately 2 inches in length, having a weight of approximately ½ ounce. For dry areas a combination of 10% sodium chloride cubes and 90% sodium chloride crystals is used. For wet areas a combination of 40–60% sodium chloride cubes is used, all these percentages being by volume.

The performance as it applies to the grounding electrode configurations of FIGS. 24, 25, and 26 is now summarized. The surrounding soil becomes saturated when the reservoirs 722, 422A, 722B are filled with the respective chemicals. The chemicals overflow through the ports 726. The chemicals first saturate the osmotic conductor 720. The osmotic conductor 720 is always wet. It is supplied with a highly conductive salt solution. The salt solution seeps out through the GAF™ and into the surrounding soil. The seepage process will condition a large percentage of the interfacing soil, thereby creating a highly conductive effect in the surrounding soil. Thus, the electrode grounding resistance is optimized.

Figure 27:
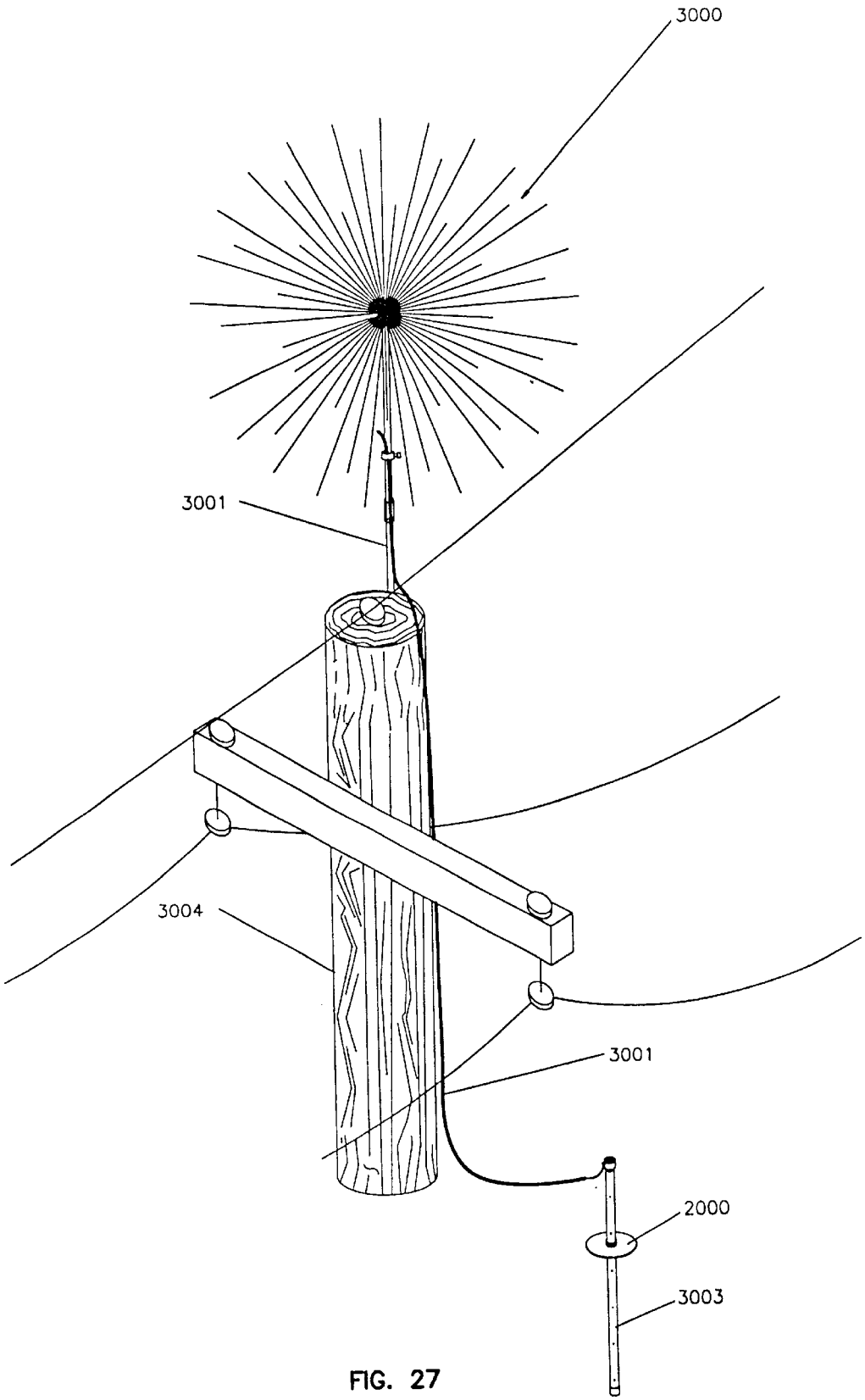
FIG. 27 is a top perspective view of the skin effect copper tubing used to connect the SBT to the grounding system.

Referring next to FIG. 27, a utility pole 3004 has a spline-ball terminal (SBT) 3000 mounted on top. The base 3001 of the SBT 3000 is fastened by brackets known in the art to utility pole 3004. The most efficient low-resistance ground wire 3002 is shown made of conventional copper pipe having an approximate one-half inch outside diameter. The use of the hollow pipe as the ground wire uses the skin effect of the pipe as well as the ordinary low impedance of the copper to minimize the surge impedance of the ground wire 3002. The grounding electrode assembly 3003 is functionally equivalent to those shown in FIG. 28.

Figure 28:
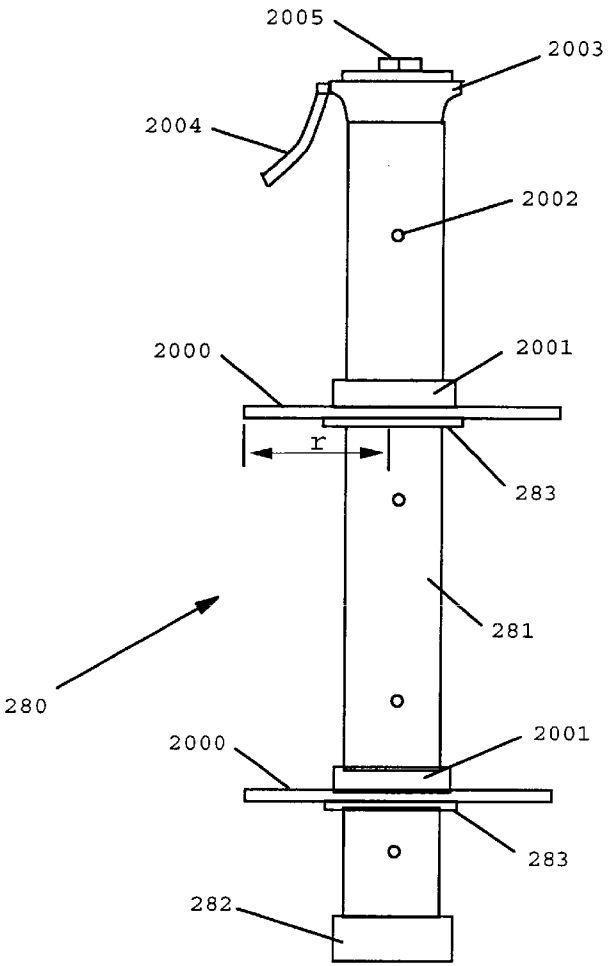
FIG. 28 is a side plan view of the preferred embodiment grounding electrode.

Referring next to FIGS. 28, 29 and 30, a grounding electrode 280 has a hollow tubular shaft 281 which is capped at the bottom 282. Conductive collars 2000 are affixed to the shaft 281 by means of a circular bracket 283. An alternate embodiment (not shown) uses punch out spikes from the punched out hole surrounded by a hose clamp. The radius r is nominally six inches. The conductive collar 2000 is preferably made of copper.

The "tuning" of the grounding electrode is to ¼ wavelength of the required frequency for applications where a tuned counterpoid would provide better antenna performance. The collar 2000 position on the shaft 281 is varied by using the locking clamp 2001. The collar position is used to obtain the desired tuning. Varying the length of the shaft 281 can also be used to vary the frequency.

The holes 2002 function to allow salts (not shown) inside the shaft 281 to form a lower resistance path to the surrounding soil the same as the prior art embodiments of FIGS. 24, 25, 26. The threaded cap 2003, and pigtail ground connecting wire 2004 are known in the prior art.

Turning now to the preferred embodiment grounding electrode shown in FIGS. 31, 32, 33, and 34 a grounding electrode 2100 is buried in a hole 2101 in the soil 2102. Such grounding electrodes are available commercially as "Chem-Rods"™ from Lightning Eliminators & Consultants, Boulder, Colo. The conductive tubular member 281 contains a chemical 2104 inside, and is surrounded by an osmotic conductor 2106 such as Ground Augmentation Fill, GAF™. A removable filler plug 2003 on the top of the tubular member provides access to the interior of the tubular member for refilling the chemical contents. A grounding connection 2004 provides for connection to the object to be grounded and/or to at least one additional grounding electrode, and is preferably made of a highly conductive, malleable metal such as copper, preferably as a woven cable. The conductive collars 2000 and 2005 are installed as shown, with collar 2000 affixed to the tubular member below mark M which is at or below the soil surface. Collar 2000 is completely buried in the soil, and any additional collars 2005 are affixed to the tubular member at lower level(s). Suitable mounting means are provided to maintain the conductive collar(s) in place along the tubular member, comprising, e.g. a threaded hose clamp or equivalent, as shown by set screw 2999. The composition (preferably copper) and structure of the conductive collar(s) are as described above. Likewise, the chemicals contained within the tubular member and the osmotic conductor surrounding the tubular member are as described above.

Figure 31:
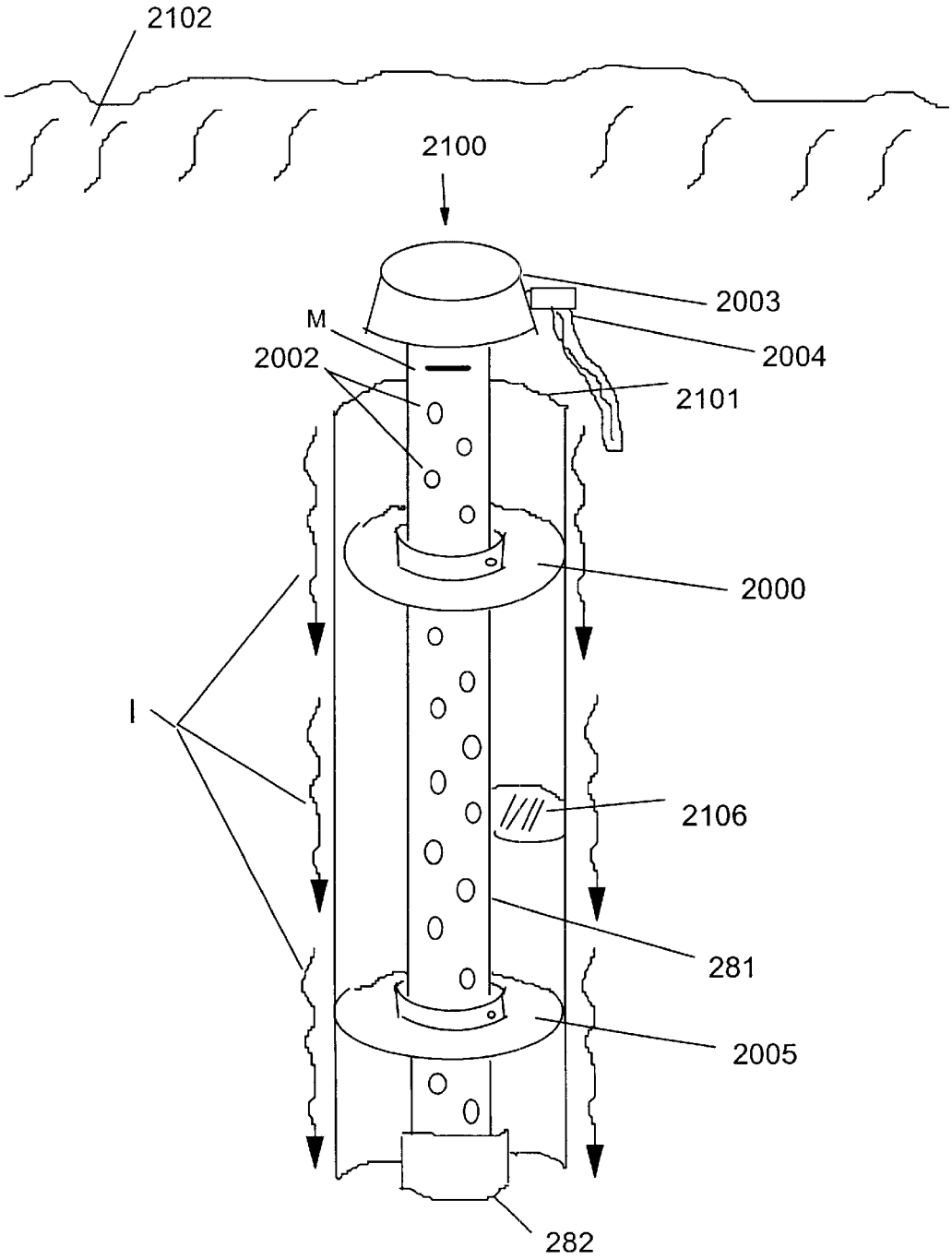
FIG. 31 is a side perspective view of the grounding electrode of the invention as installed in the ground.
Figure 32:
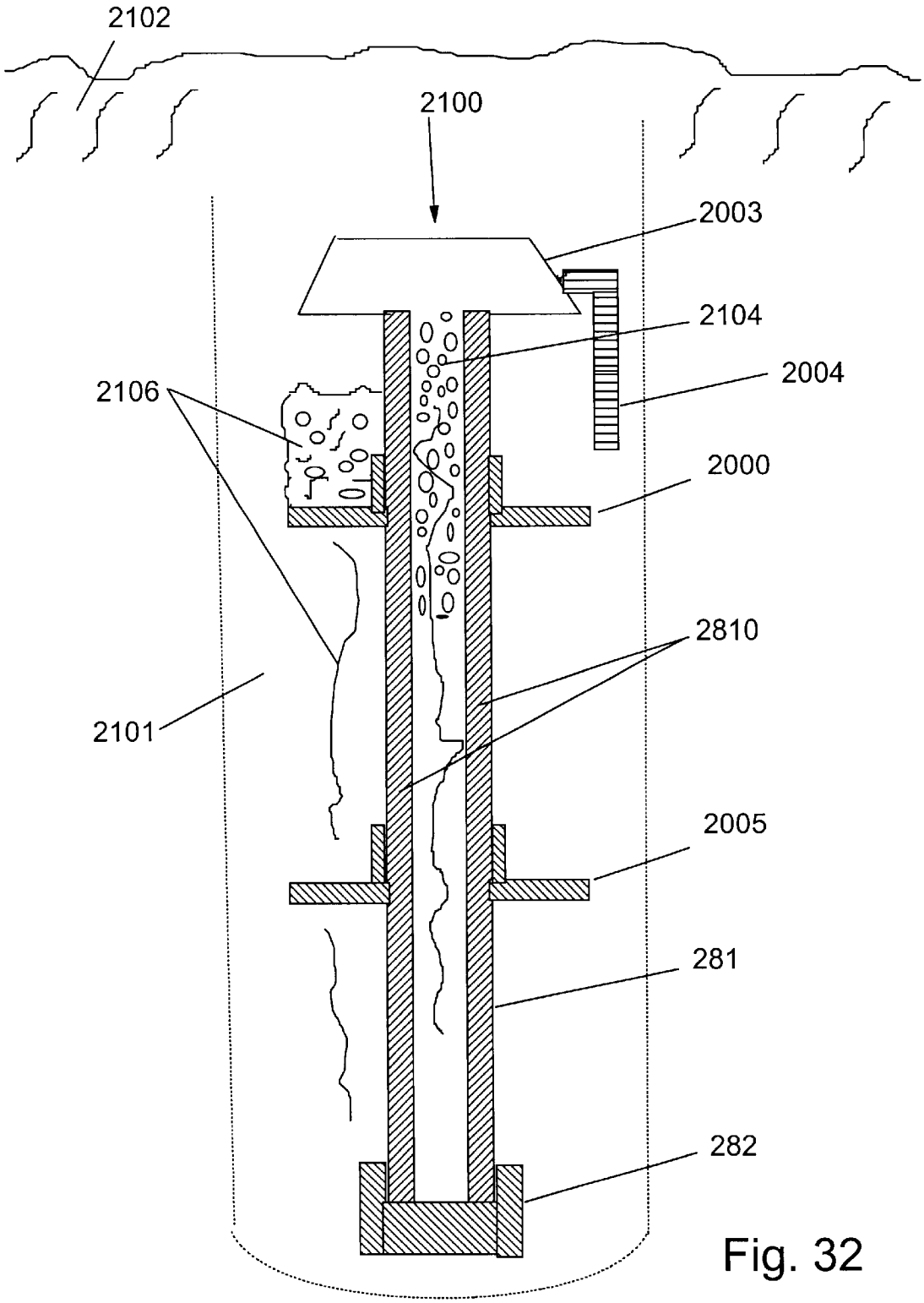
FIG. 32 is a cross-sectional view of the electrode of FIG. 31.
Figure 33:
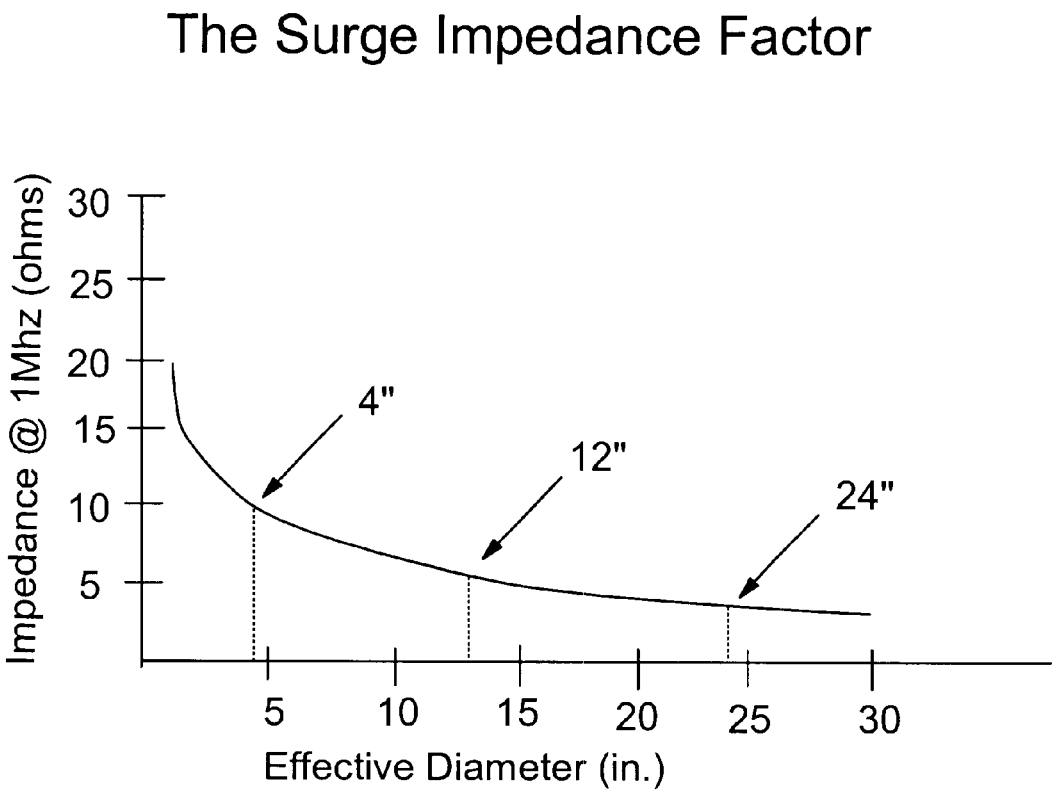
FIG. 33 is a graph showing electrode surge impedance as a function of rod diameter.
Figure 34:
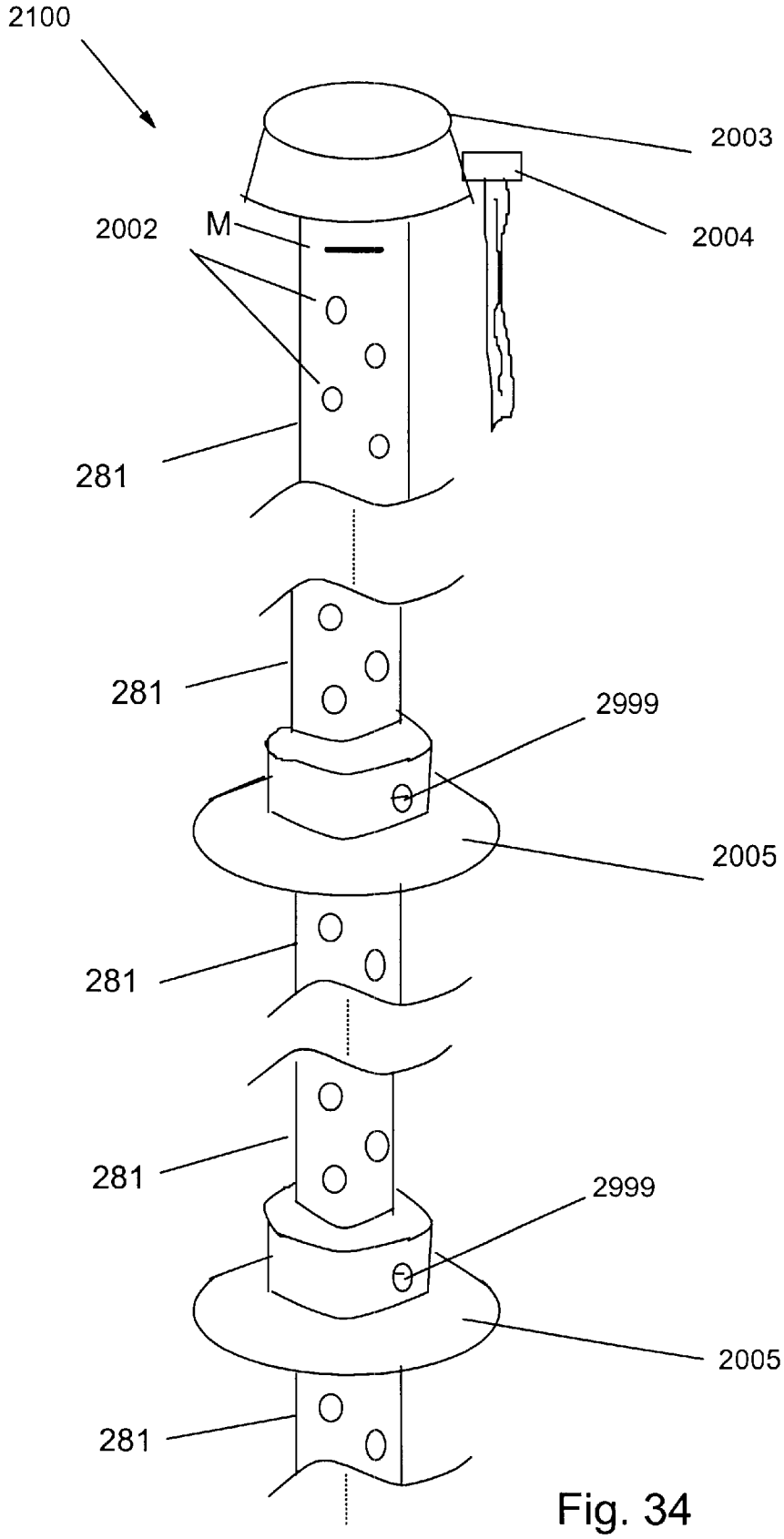
FIG. 34 is an exploded view of the preferred embodiment ground electrode.

While not wishing to be bound by theory, it is believed that the conductive collars and osmotic conductor allow current to flow along the perimeter of the assembly, much like the skin effect described above for copper tubing conductors. The expected path of the current is shown in FIG. 31 as "I".

The grounding electrode assembly with conductive collar (s) can be installed by digging a cylindrical hole 2101 of a suitable depth and having a diameter at least as large as that of the conductive collar(s). Then, an osmotic conductor is loosely poured into the hole to the depth of the lowermost collar 2005. Next the shaft 281 is tapped into the osmotic conductor to the bottom of the hole. Next the lowermost collar 2005 is mounted to the shaft on the top of the osmotic conductor and locked in place. Next the osmotic conductor is filled to the height of the uppermost collar 2000. Next the collar 2000 is affixed in place. Next the osmotic conductor is filled to the top of the hole, and the filler plug 2003 is installed. The assembly is completely buried beneath the soil by filling in soil around the periphery of the osmotic conductor material and over the top of the assembly, leaving the filler plug 2003 at the top exposed so that the chemical inside can be replenished. The filler plug 2003 has a central fitting 2090 which is threaded into the filler plug 2003, a filler tube 3508 is attached to central fitting 2090.

Environmental Background

Precipitation is normally considered as the only source of groundwater. In fact, in many regions it is the only source, or was the only source of fossil water in the past. However, there are areas where the collection of fog droplets by vegetation cannot only support the vegetation, but also make contributions to aquifers. Just like the use of underground aquifers for moisture, fog over terrain can also be used as a water source that is available for utilization.

There is always moisture in the air. The quantity varies with the temperature of the air, the physical location and its proximity to a body of water. A combination of exposure to sunlight and the water vapor pressure cause water to go into solution with air. The higher the temperature of the water, the higher the vapor pressure and the greater the volume of water boiled off and injected into the air.

The amount of water contained in air has been measured and found to vary over a wide range. Light clouds hold from 0.05 $gm/m^3$ to over 3 $gm/m^3$. Storm cells will contain much greater volumes of water.

During the daylight hours, the air will absorb large volumes of water. At night when the temperature plunges, that air becomes saturated and often releases that moisture in the form of dew. In desert areas the air will still absorb and contain moisture. This is particularly true near large bodies of water. That moisture can move inland for long distances, depending on the wind flow. Since these desert areas are subject to large changes in temperature, the moisture collected and/or brought into those areas is held in a loose suspension during the night hours and may be easily collected. As an example, consider a desert area where the temperature reaches 100° F. (37.8° C.) during the day and then plugs to near freezing at night; a temperature change of 60° F. Even if the moisture content is only 10% during the day, the moisture content is 1.5 gm/m$^3$. At night when the temperature is low, the moisture content will be the same, but the cooling process creates saturated air at that temperature. This moisture will be in a loose suspension and will settle out on anything it contacts in the form of dew.

Making an electrical connection to earth is difficult to impossible in areas where there is no moisture in the soil. There are areas in the world where there is no rainfall. However, in some of these areas there can be lightning activity because of dry blowing sand, so making an electrical connection to earth is necessary.

The effectiveness of a connection to earth is limited by the effective soil resistivity. Measurements of soil resistivity are made difficult by the lack of moisture. Sometimes measurements must be made with a high voltage because of poor conductivity and that impacts on the instrumentation. When measurements have been attempted in dry or desert areas, the results are questionable because the readings are inconsistent and sometimes not measurable. However, the actual values for this dry desert region range from 500-ohm meters to many thousands of ohmmeter in their natural state. Where moisture can be introduced, these same areas can yield reasonably conductive soil and the resistivities can be lowered to 500 ohm meters or less.

The conclusion from all of the above is that where a connection must be made to earth; particularly of 25 ohms or less, moisture must be introduced to the soil where the connection is to be made.

The question, therefore, is not do we need moisture, but rather where do we get it, and how do we add it to the soil most effectively? In fact then, we must find a source of water and develop a method of injecting into the soil uniformly to produce the desired results, a low resistance connection to earth.

To accomplish the foregoing, the present invention provides an autonomous automated moisture collector (AAMC) 3500. See FIGS. 35, 36, 37. The AAMC 3500, 3501 extracts the moisture from the air at night and stores it in a reservoir for subsequent use. It can also be referred to as a "fog collector".

The moisture collector is made up from a double layer of polypropylene (PPL) mesh mounted in frames, the base of which provides a channel for the water to flow down into the reservoir. The collector panels are mounted at a height above earth and a location away from obstructions. The mounting locations must facilitate an uninhibited passage of the local air currents. These collection panels must be deployed perpendicular to the direction of wind flow.

The AAMC 3500 works on the principal of condensate collection. This is accomplished during the night hours when the air is near the saturation state and ready to release that moisture. That condensate is then collected by the PPL mesh, conducted down into a trough and then into a reservoir. The resulting water is conducted from reservoir to the grounding electrode through a plastic tube and injected into the grounding electrode through a flow control that limits the amount of moisture injected into the grounding electrode and the surrounding soil.

These collectors are capable of providing large amounts of water, even in arid areas. Experiences in several areas have proved that this concept can produce an average of 3 liters of water per square meter of collector per day. A single grounding electrode, surrounded by the GAF™, requires about ½ liter per day under most arid area conditions.

Figure 35:
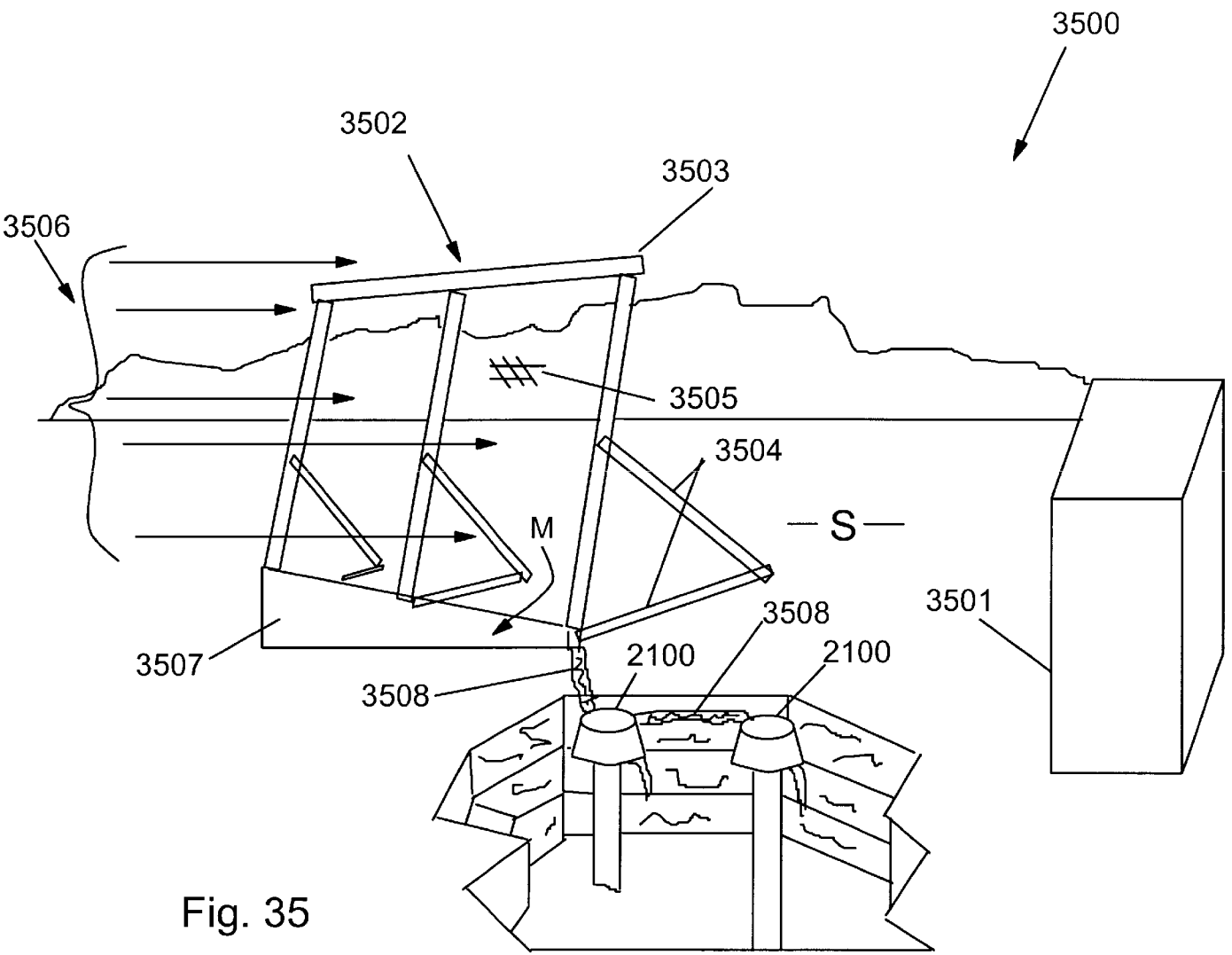
FIG. 35 is a top perspective view of the preferred embodiment moisture collector system connected to a plurality of grounding electrodes.

Referring next to FIG. 35 the preferred embodiment moisture collector and grounding electrode system 3500 is shown. A plurality of grounding electrodes 2100 are electrically connected to a protected facility 350/in a known manner. A moisture collector 3502 is mounted on the earth's surface S adjacent the grounding electrodes 2100.

A framework 3503 is supported by a stand 3504. Inside the framework 3503 is a mesh screen 3505 which is preferably a double layer of polypropylenes with a square mesh size ranging from about 0.08 to 1.5 cm.

The moisture laden air 3506 condenses out moisture M which collects in a drip collection tray 3507. A tube 3508 feeds the moisture M to the grounding electrode(s) 2100. The moisture M then travels down the inside 2810 (FIG. 32) of hollow tubular shaft 281 and out the holes 2002 into the adjacent soil. Of course, it is preferred if a conductive chemical is in the inside 2810 of the hollow tubular shaft 281, as well as an osmotic conductor in the adjacent soil. Thus, passively moisture is drawn from the ambient air and transferred to the grounding electrode and/or surrounding soil. An embodiment not shown is the use of a drip type hose at the end of tube 3508 to be wound around a grounding electrode to moisten adjacent soil.

It is understood that the herein shown and described embodiments of the subject invention are illustrative and that variations or modifications, including such elements as tube dimensions, hole sizes and locations, specific parts shapes and connections, are feasibly within the spirit of these teachings.

Although the present invention has been described with reference to preferred embodiments, numerous modifications and variations can be made and still the result will come within the scope of the invention. No limitation with respect to the specific embodiments disclosed herein is intended or should be inferred.

Figure 36:
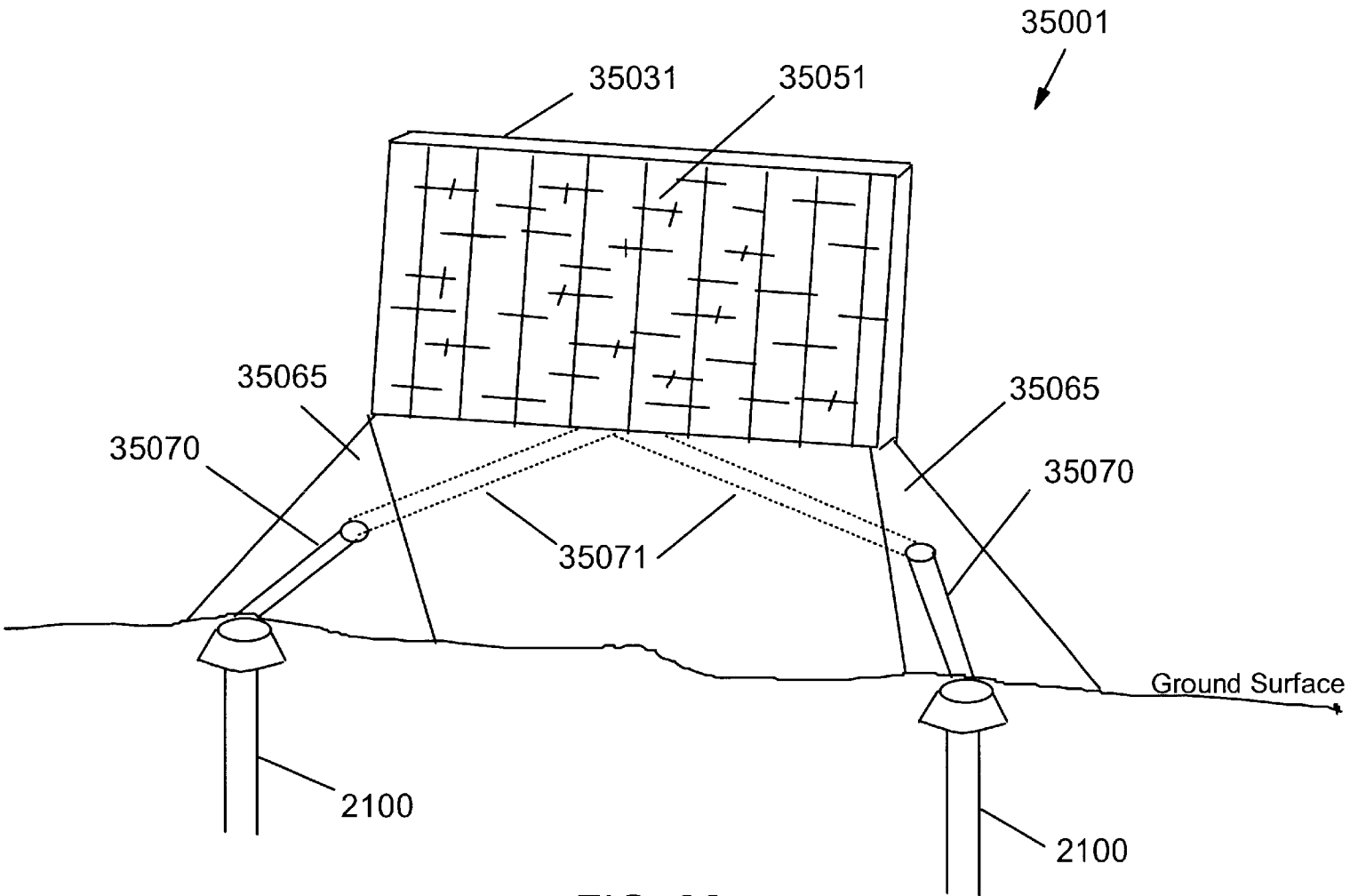
FIG. 36 is a front plan view of an alternate embodiment moisture collector and grounding electrode system.

Referring next to FIG. 36 an alternate embodiment AAMC 35001 is shown to have a stand 35065 which supports a frame 35031 and mesh 35051. A conducting trough 35071 is angled under the frame 35031 to collect the moisture. Connecting tubing 35070 is piped to several grounding electrodes 2100. Some grounding electrodes as placed on either side of the frame 35031, and could circle the frame 35031.

I claim:

1. A moisture collection and grounding electrode system comprising:

a mesh screen having a support to maintain the mesh screen in a body of air;

a moisture collector connected to the mesh screen; and a connector from the moisture collector to a grounding electrode, thereby providing moisture to the grounding electrode.

2. The system of claim 1, wherein the mesh screen further comprises a dual layer of polypropylene.

3. The system of claim 1, wherein the support further comprises a frame, the moisture collector further comprises a trough mounted below the frame, and the connector further comprises a tube.

4. The system of claim 3, wherein the grounding electrode further comprises a top having a connection to the tube.

5. The system of claim 3, wherein the grounding electrode further comprises a plurality of grounding electrodes each connected to the trough.

6. The system of claim 3, wherein the grounding electrode further comprises a hollow core containing a salt and a surrounding soil containing a low resistance soil.

7. The system of claim 6, wherein the grounding electrode further comprises a collar extending into the surrounding soil.

8. A grounding electrode system comprising:

a moisture collector mounted in a body of ambient air;

a grounding electrode buried in ambient earth; and a connector means functioning to transport moisture from the moisture collector to the grounding electrode.

9. The system of claim 8 further comprising a low resistance backfill surrounding the grounding electrode.

10. The system of claim 9, wherein the grounding electrode further comprises a hollow core containing a salt, said hollow core having a hole.

11. The system of claim 10, wherein the grounding electrode further comprises a collar buried in the backfill.

12. A grounding system for a protected facility, said grounding system comprising:

a fog collection means functioning to collect moisture from the ambient air;

a grounding electrode means functioning to provide a low impedance path for lightning from a protected facility through a grounding wire to the grounding electrode; and a connection means functioning to transport moisture from the fog collection means to the grounding electrode means.

13. The system of claim 12, wherein the fog collection means further comprises a frame supported mesh.

14. The system of claim 13, wherein the connection means further comprises a tube running from a trough below the frame supported mesh to the grounding electrode means.

15. The system of claim 14, wherein the grounding electrode means further comprises a hollow core with a salt, the core having a hole, the grounding electrode means having a top receiving the tube.

16. The system of claim 14, wherein the tube further comprises a drip tube adjacent the grounding electrode.

17. The system of claim 13, wherein the mesh further comprises a double layer propylene mesh.

18. The system of claim 12, wherein the grounding electrode means further comprises a hollow core having a hole, said core containing a salt.

19. The system of claim 18, wherein the grounding electrode means further comprises a low resistance backfill surrounding the core.

20. The system of claim 19, wherein the core further comprises a collar in fluid communication with the backfill.

* * * * *